US009933171B2

(12) United States Patent
Wong

(10) Patent No.: US 9,933,171 B2
(45) Date of Patent: Apr. 3, 2018

(54) AIR CONDITIONING AND HEAT PUMP SYSTEM WITH EVAPORATIVE COOLING SYSTEM

(71) Applicant: Lee Wa Wong, Pico Rivera, CA (US)

(72) Inventor: Lee Wa Wong, Pico Rivera, CA (US)

( * ) Notice: Subject to any disclaimer, the term of this patent is extended or adjusted under 35 U.S.C. 154(b) by 658 days.

(21) Appl. No.: 14/500,719

(22) Filed: Sep. 29, 2014

(65) Prior Publication Data

US 2016/0091215 A1 Mar. 31, 2016

(51) Int. Cl.

| | |
|---|---|
| ***F24F 5/00*** | (2006.01) |
| ***F25B 49/02*** | (2006.01) |
| ***F25B 13/00*** | (2006.01) |
| ***F24F 3/00*** | (2006.01) |

(52) U.S. Cl.

CPC ..... *F24F 5/001* (2013.01); *F24F 3/001* (2013.01); *F25B 13/00* (2013.01); *F25B 2313/003* (2013.01); *F25B 2313/023* (2013.01); *F25B 2313/027* (2013.01); *F25B 2339/047* (2013.01)

(58) Field of Classification Search

CPC ..... F24F 5/001; F24F 3/001; F25B 2313/003; F25B 2339/047; F25B 2313/027

See application file for complete search history.

(56) References Cited

U.S. PATENT DOCUMENTS

| | | | | | |
|---|---|---|---|---|---|
| 2,493,141 | A * | 1/1950 | Henney | B61D 27/0072 | 62/120 |
| 3,012,416 | A * | 12/1961 | Dart | F28B 1/06 | 261/109 |
| 3,030,226 | A * | 4/1962 | Heaton | C23C 2/00 | 118/423 |
| 3,365,909 | A * | 1/1968 | Brainard | F28D 5/02 | 137/268 |
| 3,654,988 | A * | 4/1972 | Clayton, III | F24F 3/06 | 165/219 |
| 3,864,442 | A * | 2/1975 | Percy | F28C 1/14 | 165/160 |
| 4,112,027 | A * | 9/1978 | Cates | F28C 1/14 | 165/900 |
| 4,119,140 | A * | 10/1978 | Cates | F28B 1/06 | 165/115 |
| 4,182,131 | A * | 1/1980 | Marshall | F24F 5/001 | 62/305 |
| 4,893,669 | A * | 1/1990 | Kashiwada | F28C 1/04 | 165/103 |

(Continued)

*Primary Examiner* — Kun Kai Ma
(74) *Attorney, Agent, or Firm* — Tsz Lung Yeung

(57) ABSTRACT

An air conditioning and heat pump system includes a multi-communicative valve unit, a compressor unit connected to the multi-communicative valve unit, an evaporator unit connected to the multi-communicative valve unit, a heat exchanger connected to multi-communicative valve unit, a water heater connected to the compressor unit and the multi-communicative valve unit, and an evaporative cooling system which comprises at least one multiple-effect evaporative condenser for effectively cooling the working fluid. The air conditioning and heat pump system is selectively operated in one of an air conditioning mode, a heat pump mode, a water heater mode, and a defrosting mode, and can be switched such that the working fluid can either be cooled by the evaporator unit or and evaporative cooling system.

16 Claims, 25 Drawing Sheets

(56) References Cited

U.S. PATENT DOCUMENTS 5,435,382 A * 7/1995 Carter ..... F28C 1/14 165/110
5,901,567 A * 5/1999 Suzuki ..... F25B 15/02 62/324.2
6,070,426 A * 6/2000 Sakashita ..... F25B 39/04 62/114
6,244,057 B1 * 6/2001 Yoshida ..... F25B 13/00 62/151
2003/0029185 A1 * 2/2003 Kopko ..... F24F 3/044 62/271
2003/0205055 A1 * 11/2003 Shahbaz ..... F24F 3/14 62/331
2004/0031282 A1 * 2/2004 Kopko ..... F24F 3/1417 62/271
2005/0056042 A1 * 3/2005 Bourne ..... F24F 3/044 62/310
2005/0089441 A1 * 4/2005 Coffey ..... C02F 1/02 422/1
2008/0197206 A1 * 8/2008 Murakami ..... F25B 13/00 237/2 B
2009/0013702 A1 * 1/2009 Murakami ..... F25B 13/00 62/118
2009/0049857 A1 * 2/2009 Murakami ..... F25B 13/00 62/324.6
2010/0281896 A1 * 11/2010 Al Watban ..... F24F 5/0035 62/160
2011/0048054 A1 * 3/2011 Sekine ..... F25B 13/00 62/324.6
2011/0154848 A1 * 6/2011 Jin ..... F24D 3/18 62/324.6
2011/0283725 A1 * 11/2011 Sim ..... F24D 11/0214 62/151
2012/0266616 A1 * 10/2012 Lee ..... F25B 13/00 62/80
2013/0145785 A1 * 6/2013 Nobuhiro ..... F25B 49/02 62/160
2013/0160985 A1 6/2013 Chen et al.
2013/0269378 A1 * 10/2013 Wong ..... F25B 13/00 62/160
2013/0276476 A1 * 10/2013 Wong ..... F28F 25/04 62/513
2014/0116072 A1 * 5/2014 Kim ..... F24D 3/18 62/79
2016/0102873 A1 * 4/2016 Harris ..... F24F 7/08 165/217

* cited by examiner

| Valve | Connecting Valve 41 | Connecting Valve 42 | Connecting Valve 43 | Connecting Valve 44 |
|---|---|---|---|---|
| **Normal Mode** | 401 ←→ 402<br>403 ←→ 404 | 405 ←→ 406<br>407 ←→ 408 | 409 ←→ 410<br>411 ←→ 412 | 413 ←→ 414<br>415 ←→ 416 |
| **Switched Mode** | 401 ←→ 404<br>402 ←→ 403 | 405 ←→ 408<br>406 ←→ 407 | 409 ←→ 412<br>410 ←→ 411 | 413 ←→ 416<br>414 ←→ 415 |

Fig. 22

| | Connecting Valve 41 | Connecting Valve 42 | Connecting Valve 43 | Connecting Valve 44 |
|---|---|---|---|---|
| Air Conditioning Mode | Normal Mode | Normal Mode | Normal Mode | Normal Mode |
| Heat Pump Mode | Normal Mode | Switched Mode | Switched Mode | Switched Mode |
| Water Heating Mode | Switched Mode | Switched Mode | Switched Mode | Switched Mode |
| Defrosting Mode | Normal Mode | Normal Mode | Switched Mode | Normal Mode |

Fig. 23

| Valve | Connecting Valve 41' | Connecting Valve 42' | Connecting Valve 43' | Connecting Valve 44' |
|---|---|---|---|---|
| **Normal Mode** | 401' ←→ 402'<br>403' ←→ 404' | 405' ←→ 406'<br>407' ←→ 408' | 409' ←→ 410'<br>411' ←→ 412' | 413' ←→ 414'<br>415' ←→ 416' |
| **Switched Mode** | 401' ←→ 404'<br>402' ←→ 403' | 405' ←→ 408'<br>406' ←→ 407' | 409' ←→ 412'<br>410' ←→ 411' | 413' ←→ 416'<br>414' ←→ 415' |

Fig. 25

| | Connecting Valve 41' | Connecting Valve 42' | Connecting Valve 43' | Connecting Valve 44' |
|---|---|---|---|---|
| Air Conditioning Mode | Normal Mode | Normal Mode | Normal Mode | Normal Mode |
| Heat Pump Mode | Normal Mode | Switched Mode | Switched Mode | Switched Mode |
| Water Heating Mode | Switched Mode | Normal Mode | Normal Mode | Switched Mode |
| Defrosting Mode | Normal Mode | Normal Mode | Switched Mode | Normal Mode |

Fig. 26

| Valve | First Connecting Valve 41" | Second Connecting Valve 42" |
|---|---|---|
| **Normal Mode** | 401" ←→ 402"<br>403" ←→ 404" | 405" ←→ 406"<br>407" ←→ 408" |
| **Switched Mode** | 401" ←→ 404"<br>402" ←→ 403" | 405" ←→ 408"<br>406" ←→ 407" |

Fig. 30

| | **First Connecting Valve 41"** | **Second Connecting Valve 42"** | **Multi-communicative Valve 29"** |
|---|---|---|---|
| Air Conditioning Mode | Normal Mode | Normal Mode | Normal Mode |
| Heat Pump Mode | Normal Mode | Switched Mode | Switched Mode |
| Water Heating Mode | Switched Mode | Normal Mode | Switched Mode |
| Defrosting Mode | Normal Mode | Switched Mode | Normal Mode |

Fig. 31

AIR CONDITIONING AND HEAT PUMP SYSTEM WITH EVAPORATIVE COOLING SYSTEM

BACKGROUND OF THE PRESENT INVENTION

Field of Invention

The present invention relates to an air conditioning and heat pump system, and more particularly to an air conditioning and heat pump system comprising a multiple-effect evaporative condenser which has a substantially improved energy efficiency and water consumption requirement as compared to conventional cooling techniques for a heat pump system.

Description of Related Arts

Conventional air conditioning and heat pump systems have been widely utilized for over hundred years. A common disadvantage is that conventional heat pump systems have very low Coefficient of Performance (C.O.P). This means that the efficiency of the entire system is rather low. Typically speaking, the C.O.P. of a central air conditioning and heat pump system is approximately 3.2. There is a need to develop an air conditioning and heat pump system which have a substantially enhanced C.O.P.

SUMMARY OF THE PRESENT INVENTION

An objective of the present invention is to provide an air conditioning and heat pump system comprising a multiple-effect evaporative condenser which has a substantially improved energy efficiency and water consumption requirement as compared to conventional heat pump systems.

An objective of the present invention is to provide an air conditioning and heat pump system which can be selectively operated in an air conditioning mode, a heat pump mode, a water heater mode, and a defrosting mode.

Another objective of the present invention is to provide a multiple-effect evaporative condenser for an air conditioning and heat pump system which eliminates the need to have any cooling tower for cooling working fluid such as refrigerant. In other words, the overall manufacturing and maintenance cost of the air conditioning system can be substantially reduced.

Another objective of the present invention is to provide an air conditioning and heat pump system comprising a multiple-effect evaporative condenser which utilizes a plurality of highly efficient heat exchanging pipes for providing a relatively larger area of heat exchanging surfaces.

Another objective of the present invention is to provide an air conditioning and heat pump system comprising a multiple-effect evaporative condenser which substantially lowers the circulating volume and the rate of cooling water, and the required power for water pumps. Thus, the present invention saves a substantial amount of energy as compared to conventional air conditioning system utilizing water towers.

Another objective of the present invention is to provide an air conditioning and heat pump system, wherein the working fluid such as refrigerant may be selectively cooled by cooling water or ambient air.

In one aspect of the present invention, it provides an air conditioning and heat pump system using a predetermined amount of working fluid, comprising:

a multi-communicative valve unit;

a compressor unit connected to the multi-communicative valve unit;

an evaporator unit connected to the multi-communicative valve unit;

a heat exchanger connected to multi-communicative valve unit;

a water heater connected to the compressor unit and the multi-communicative valve unit; and an evaporative cooling system which comprises at least one multiple-effect evaporative condenser connected to the compressor unit for effectively cooling the working fluid, the multiple-effect evaporative condenser comprising:

an air inlet side and an air outlet side which is opposite to the air inlet side;

a pumping device adapted for pumping a predetermined amount of cooling water at a predetermined flow rate;

a first cooling unit, comprising:

a first water collection basin for collecting the cooling water from the pumping device;

a plurality of first heat exchanging pipes connected to the condenser and immersed in the first water collection basin; and a first fill material unit provided underneath the first heat exchanging pipes, wherein the cooling water collected in the first water collection basin is arranged to sequentially flow through exterior surfaces of the first heat exchanging pipes and the first fill material unit;

a second cooling unit, comprising:

a second water collection basin positioned underneath the first cooling unit for collecting the cooling water flowing from the first cooling unit;

a plurality of second heat exchanging pipes immersed in the second water collection basin; and a second fill material unit provided underneath the second heat exchanging pipes, wherein the cooling water collected in the second water collection basin is arranged to sequentially flow through exterior surfaces of the second heat exchanging pipes and the second fill material unit; and a bottom water collecting basin positioned underneath the second cooling unit for collecting the cooling water flowing from the second cooling unit;

the air conditioning and heat pump system being selectively operated in one of an air conditioning mode, a heat pump mode, and a water heater mode, wherein in the air conditioning mode, the working fluid is guided by the multi-communicative valve to sequentially circulate through the compressor unit, the water heater for releasing heat to a predetermined amount of water, the multiple-effect evaporative condenser for being cooled down by a predetermined amount of cooling water, the heat exchanger for absorbing heat from an indoor space, and back to the compressor unit;

wherein in the heat pump mode, the working fluid is guided by the multi-communicative valve to sequentially circulate through the compressor unit, the water heater for releasing heat to a predetermined amount of water, the heat exchanger for releasing heat to the indoor space, the evaporator unit for absorbing heat from ambient air, and back to the compressor unit; and wherein in the water heater mode, the working fluid is guided by the multi-communicative valve to sequentially circulate through the compressor unit, the water heater for releasing heat to a predetermined of water, the evaporator unit for absorbing heat from ambient air, and back to the compressor unit.

BRIEF DESCRIPTION OF THE DRAWINGS

FIG. 22 is a connection table for first through fourth connecting valve of the air conditioning and heat pump system according to the preferred embodiment of the present invention.

FIG. 23 is a status table for first through fourth connecting valve of the air conditioning and heat pump system according to the preferred embodiment of the present invention.

FIG. 25 is a connection table for first through fourth connecting valve of the air conditioning and heat pump system according to the first alternative mode of the preferred embodiment of the present invention.

FIG. 26 is a status table for first through fourth connecting valve of the air conditioning and heat pump system according to the first alternative mode of the preferred embodiment of the present invention.

FIG. 30 is a connection table for first through second connecting valve of the air conditioning and heat pump system according to the second alternative mode of the preferred embodiment of the present invention.

FIG. 31 is a status table for first through second connecting valve and the multi-communicative valve of the air conditioning and heat pump system according to the first alternative mode of the preferred embodiment of the present invention.

DETAILED DESCRIPTION OF THE PREFERRED EMBODIMENT

Figure 1:
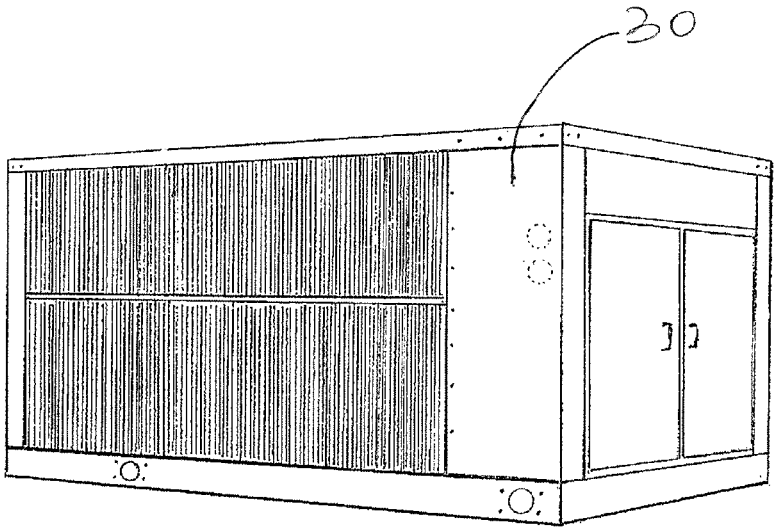
FIG. 1 is a perspective view of an air conditioning and heat pump system according to a preferred embodiment of the present invention.
Figure 2:
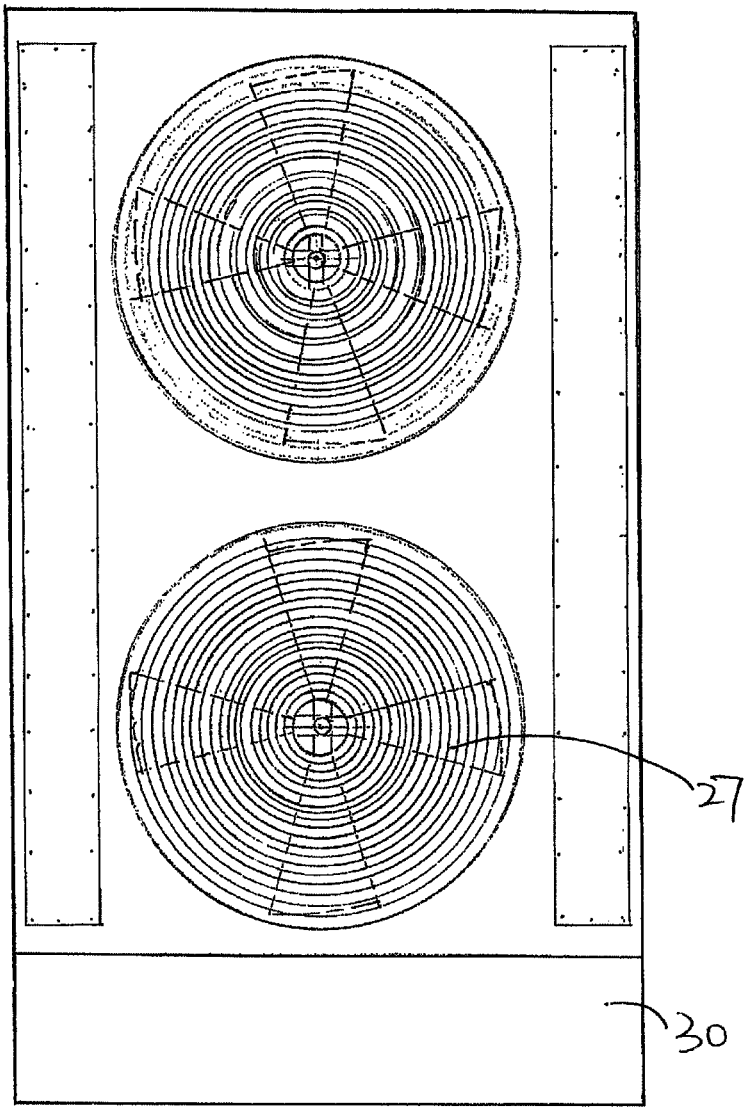
FIG. 2 is a plan view of the air conditioning and heat pump system according to the preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 10 of the drawings, an air conditioning and heat pump system according to a preferred embodiment of the present invention is illustrated. Broadly, the air conditioning and heat pump system comprises at least one evaporator unit 2, at least one compressor unit 1, at least one heat exchanger 45, at least one water heater 46, and at least one evaporative cooling systems 200 each comprising two multiple-effect evaporative condensers 5. The air conditioning and heat pump system utilizes a predetermined amount of working fluid, such as a predetermined amount of refrigerant, for performing heat exchange in various components of the air conditioning and heat pump system so as to selectively producing hot air, cooled air and hot water for a predetermined indoor space.

The air conditioning and heat pump system further comprises an outer housing 30 for accommodating the evaporator unit 2, the compressor unit 1, the heat exchanger 45, the water heater 46, and the multiple-effect evaporative condensers 5. The outdoor housing 30 further comprises at least one cooling fan 27 provided on top of the outer housing 30.

Figure 3:
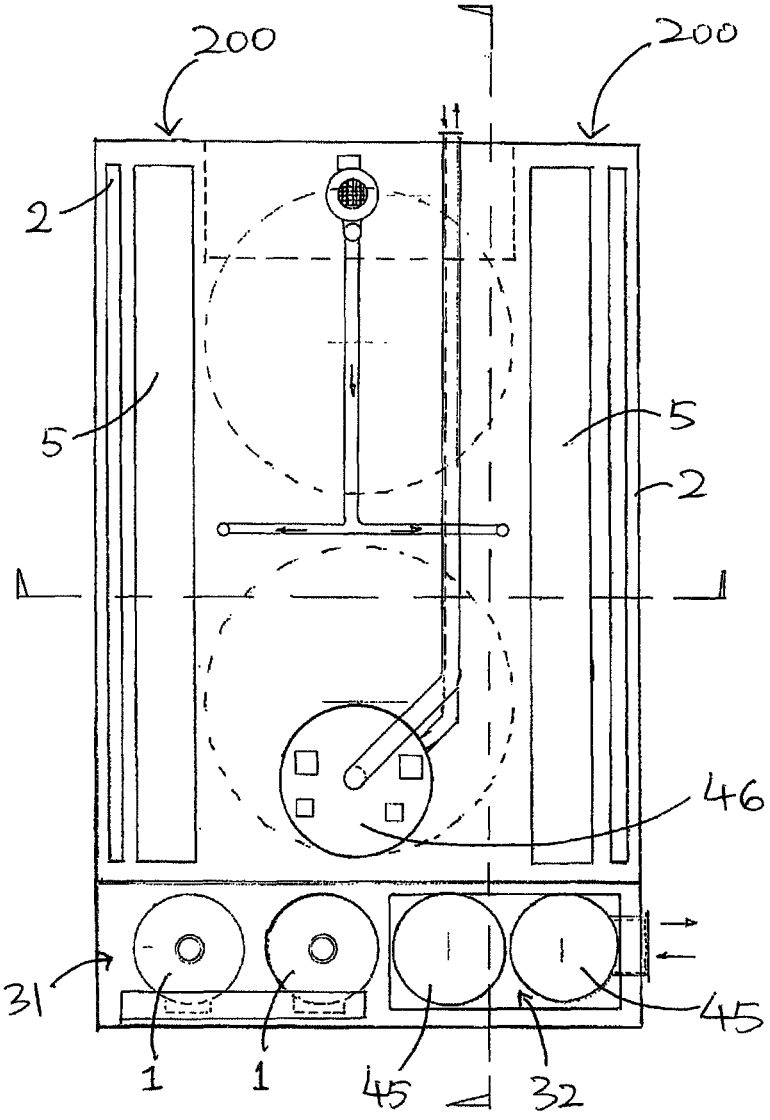
FIG. 3 is a sectional plan view of the air conditioning and heat pump system according to the first preferred embodiment of the present invention.

As shown in FIG. 3 of the drawings, the outer housing 30 has a compressor compartment 31 for accommodating the compressor unit 1. Preferably, there are two compressor units 1 accommodated in the compressor compartment 31. However, the number of the compressor units 1 may be varied to suit different circumstances in which the present invention is operated. The outer housing 30 further has an evaporator compartment 32 for accommodating the heat exchanger 45. Preferably, there are two heat exchangers 45 accommodated in the evaporator compartment 12. However, the number of the heat exchanger 45 may be varied to suit different circumstances in which the present invention is operated. The compressor compartment 31 and the evaporator compartment 32 may be provided in a side-by-side manner at one transverse side of the outer housing 30 as shown in FIG. 3 of the drawings. Each one of the compressor units 1, evaporator units 2, heat exchangers 45, the evaporative cooling systems 200, and the water heater 46 are arranged in a predetermined manner to form a refrigerant cycle for producing hot air, cooled air, and hot water in the indoor space.

As shown in FIG. 3 of the drawings, each of the evaporative cooling systems 200 is position at one longitudinal side portion of the outer housing 30, while the evaporator units 2 are also provided at two outer sides of the evaporative cooling systems 200 respectively. In other words, the evaporator units 2 are also provided at two longitudinal side portions of the outer housing 30 respectively. Preferably, the evaporator units 2 are the two outmost elements accommodated in the outer housing 30, while the evaporative cooling systems 200 are provided immediately next to the evaporator units 2 respectively along a transverse direction of the outer housing 30.

In this preferred embodiment, each of the evaporative cooling systems 200 comprises two multiple-effect evaporative units 5. However, the number of the multiple-effect evaporator units 5 may also be varied to suit different circumstances in which the present invention is operated. The multiple-effect evaporative condensers 5 are provided at two longitudinal sides of the outer housing 30 respectively and are connected to the compressor units 1 for cooling a predetermined amount of refrigerant circulating through the air conditioning and heat pump system.

Each of the multiple-effect evaporative condensers 5 comprises a pumping device 4 positioned in the outer housing 30, a first cooling unit 6, a second cooling unit 7, and a bottom water collection basin 100. Each of the multiple-effect evaporative condensers 5 also has an air inlet side 51 and an air outlet side 52 which is opposite to the air inlet side 51. The evaporator units 2 are provided adjacent to two air inlet sides 51 of the multiple-effect evaporative condensers 5 respectively. Air is drawn to first flow through the evaporator units 2 and then the multiple-effect evaporative condensers 5.

Figure 5:
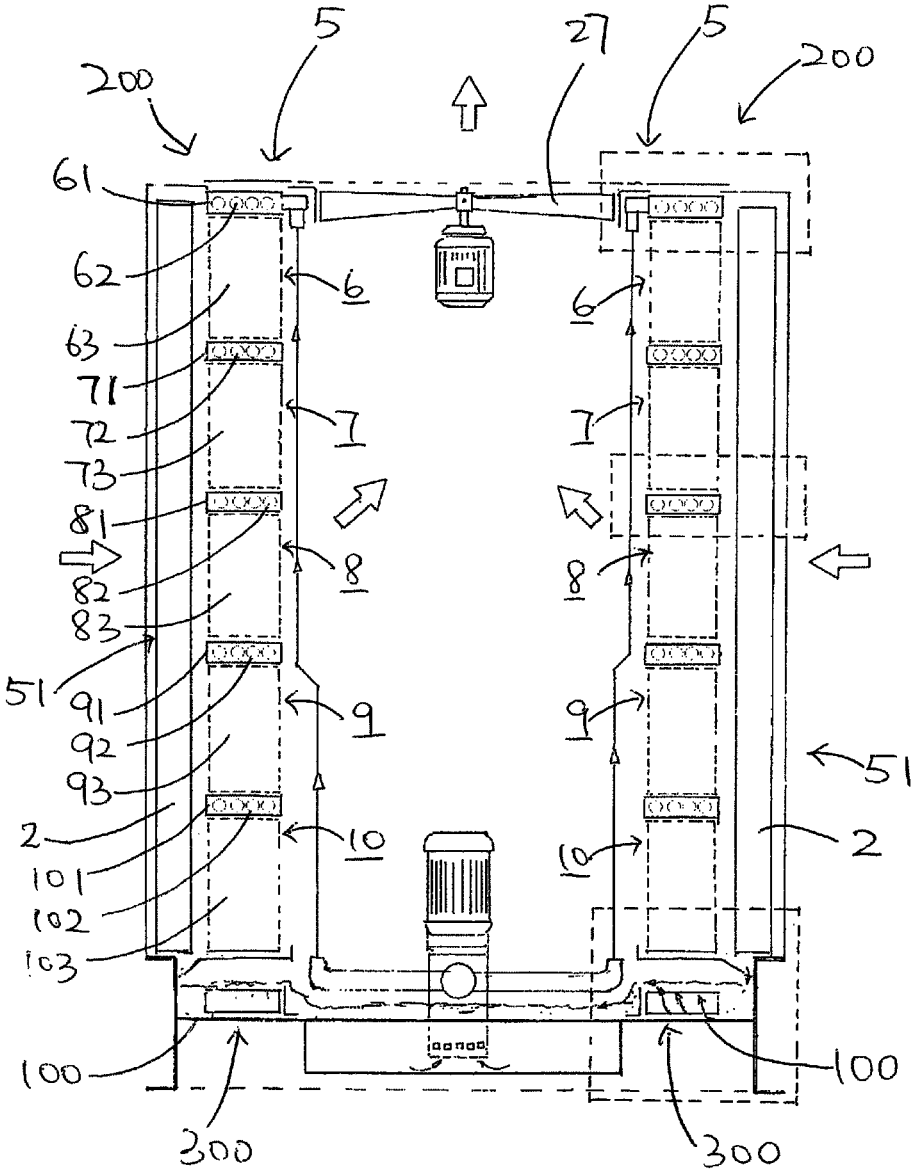
FIG. 5 is a sectional view of the air conditioning and heat pump system alone plane A-A of FIG. 3, illustrating that the multiple-effect evaporative condenser has five cooling units.

The pumping device 4 is adapted for pumping a predetermined amount of cooling water at a predetermined flow rate. Each of the multiple-effect evaporative condensers 5 may have its own pumping device 4. Alternatively, several (such as two) multiple-effect evaporative condensers 5 may share one single pumping device 4 for circulating the cooling water in each of the multiple-effect evaporative condensers 5, as shown in FIG. 5 of the drawings.

Figure 6:
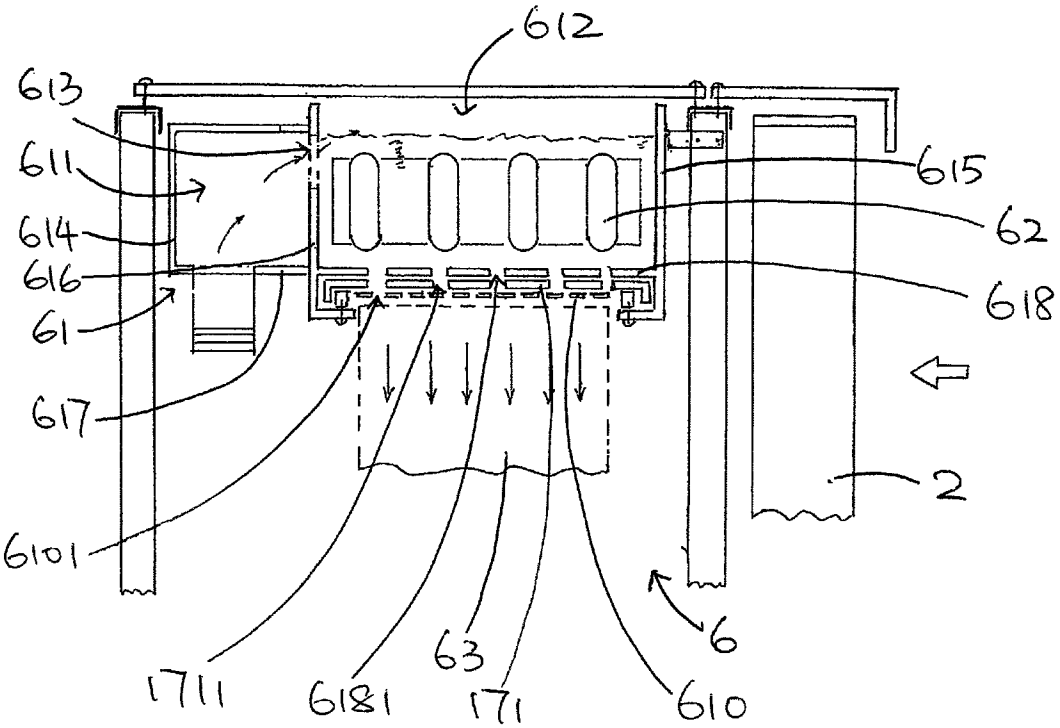
FIG. 6 is a schematic diagram of first cooling unit of the multiple-effect evaporative condenser according to the preferred embodiment of the present invention.
Figure 7:
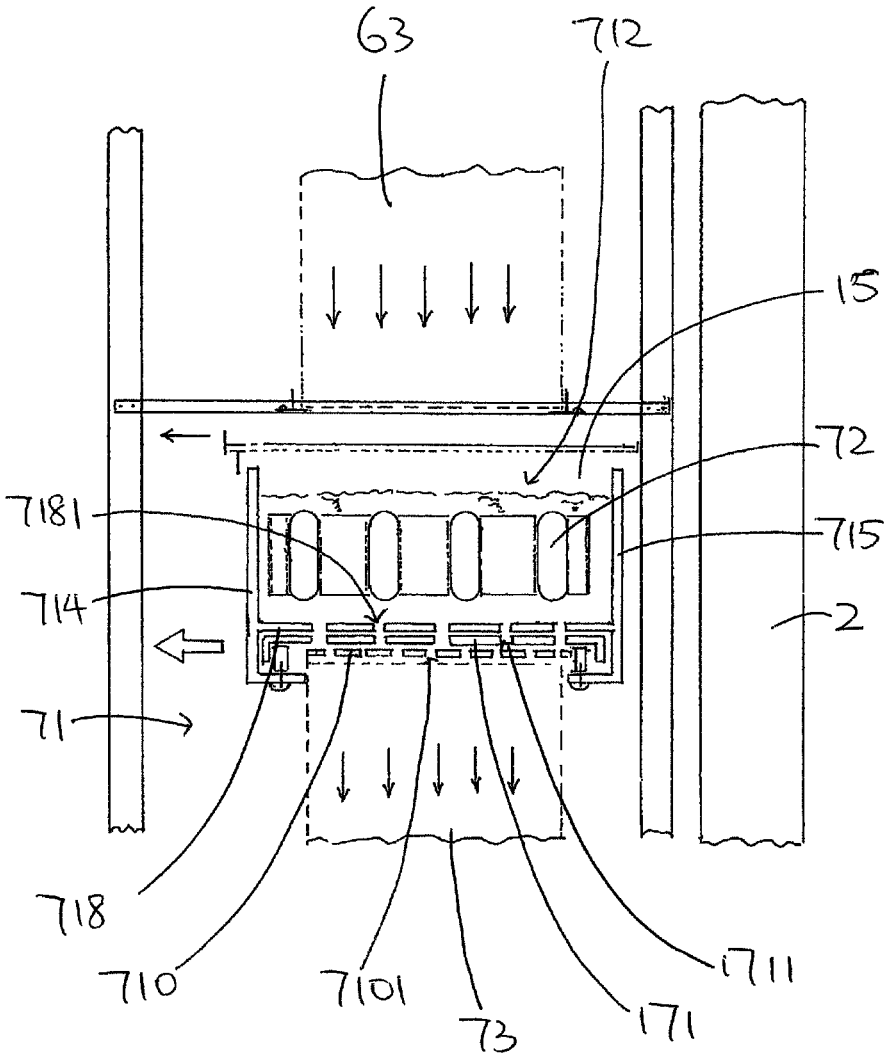
FIG. 7 is a schematic diagram of second cooling unit of the multiple-effect evaporative condenser according to the preferred embodiment of the present invention.
Figure 8:
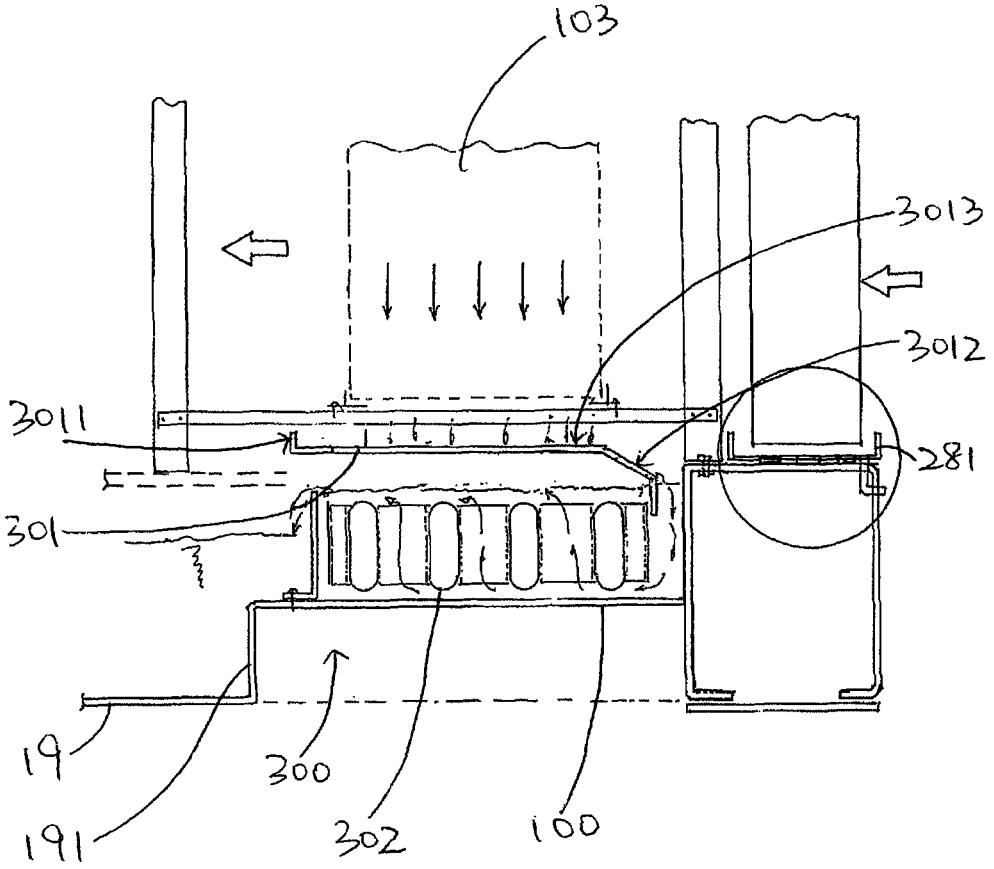
FIG. 8 is a schematic diagram of bottom cooling unit of the multiple-effect evaporative condenser according to the preferred embodiment of the present invention.

As shown in FIG. 6 to FIG. 8 of the drawings, the first cooling unit 6 comprises a first water collection basin 61 for collecting the cooling water from the pumping device 4, a plurality of first heat exchanging pipes 62 connected to the relevant compressor unit 1 and immersed in the first water collection basin 61, and a first fill material unit 63 provided underneath the first heat exchanging pipes 62, wherein the cooling water collected in the first water collection basin 61 is arranged to sequentially flow through exterior surfaces of the first heat exchanging pipes 62 and the first fill material unit 63 for forming a thin water film therein.

On the other hand, as shown in FIG. 7 of the drawings, the second cooling unit 7 comprises a second water collection basin 71 positioned underneath the first cooling unit 6 for collecting the cooling water flowing from the first cooling unit 6, a plurality of second heat exchanging pipes 72 immersed in the second water collection basin 71, and a second fill material unit 73 provided underneath the second heat exchanging pipes 72. The cooling water collected in the second water collection basin 71 is arranged to sequentially flow through exterior surfaces of the second heat exchanging pipes 72 and the second fill material unit 73 for forming a thin water film therein.

As shown in FIG. 8 of the drawings, the bottom water collecting basin 300 is positioned underneath the second cooling unit 7 for collecting the cooling water flowing from the second cooling unit 7. The cooling water collected in the bottom water collection tank 300 is arranged to be guided to flow back into the first water collection basin 61 of the first cooling unit 6. On the other hand, the refrigerant from other components of the air conditioning and heat pump system is arranged to flow through the first heat exchanging pipes 62 of the first cooling unit 6 and the second heat exchanging pipes 72 of the second cooling unit 7 in such a manner that the refrigerant is arranged to perform highly efficient heat exchanging process with the cooling water for lowering a temperature of the refrigerant. A predetermined amount of air is drawn from the air inlet side 51 for performing heat exchange with the cooling water flowing through the first fill material unit 63 and the second fill material unit 73 for lowering a temperature of the cooling water. The air having absorbed the heat from the cooling water is discharged out of the first fill material unit 63 and the second fill material unit 73 through the air outlet side 52.

According to the preferred embodiment of the present invention, each of the multiple-effect evaporative condensers 5 comprises first through fifth cooling units 6, 7, 8, 9, 10. The number of cooling units depend on the circumstances in which the air conditioning system is operated. FIG. 5 illustrates a situation where the multiple-effect evaporative condenser 5 comprise five cooling units, namely, the first cooling unit 6, the second cooling unit 7, the third cooling unit 8, the fourth cooling unit 9, and the fifth cooling unit 10.

The third cooling unit 8 comprises a third water collection basin 81, a plurality of third heat exchanging pipes 82 immersed in the third water collection basin 81, and a third fill material unit 83 provided under the third water collection basin 81. Similarly, the fourth cooling unit 9 comprises a fourth water collection basin 91, a plurality of fourth heat exchanging pipes 92 immersed in the fourth water collection basin 91, and a fourth fill material unit 93 provided under the fourth water collection basin 91. The fifth cooling unit 10 comprises a fifth water collection basin 101, a plurality of fifth heat exchanging pipes 102 immersed in the fifth water collection basin 101, and a fifth fill material unit 103 provided under the fifth water collection basin 101. Note that where the multiple-effect evaporative condenser 5 has more than five cooling units, each of the additional cooling units will have the same structure as that of first through fifth cooling units 5, 6, 7, 8, 9, 10. For example, a sixth cooling unit may comprise a sixth water collection basin, a plurality of sixth heat exchanging pipes, and a sixth fill material unit, so on and so forth.

FIG. 5 illustrates two multiple-effect evaporative condensers 5 which are served by one common pumping device 4. Thus, the bottom water collection basin 100 of each of the multiple-effect evaporative condensers 5 is connected to the pumping device 4 so that the cooling water collected by the bottom water collection basin 100 is arranged to be pumped by the pumping device 4 to the first cooling unit 6 of the respective multiple-effect evaporative condenser 5.

Figure 4:
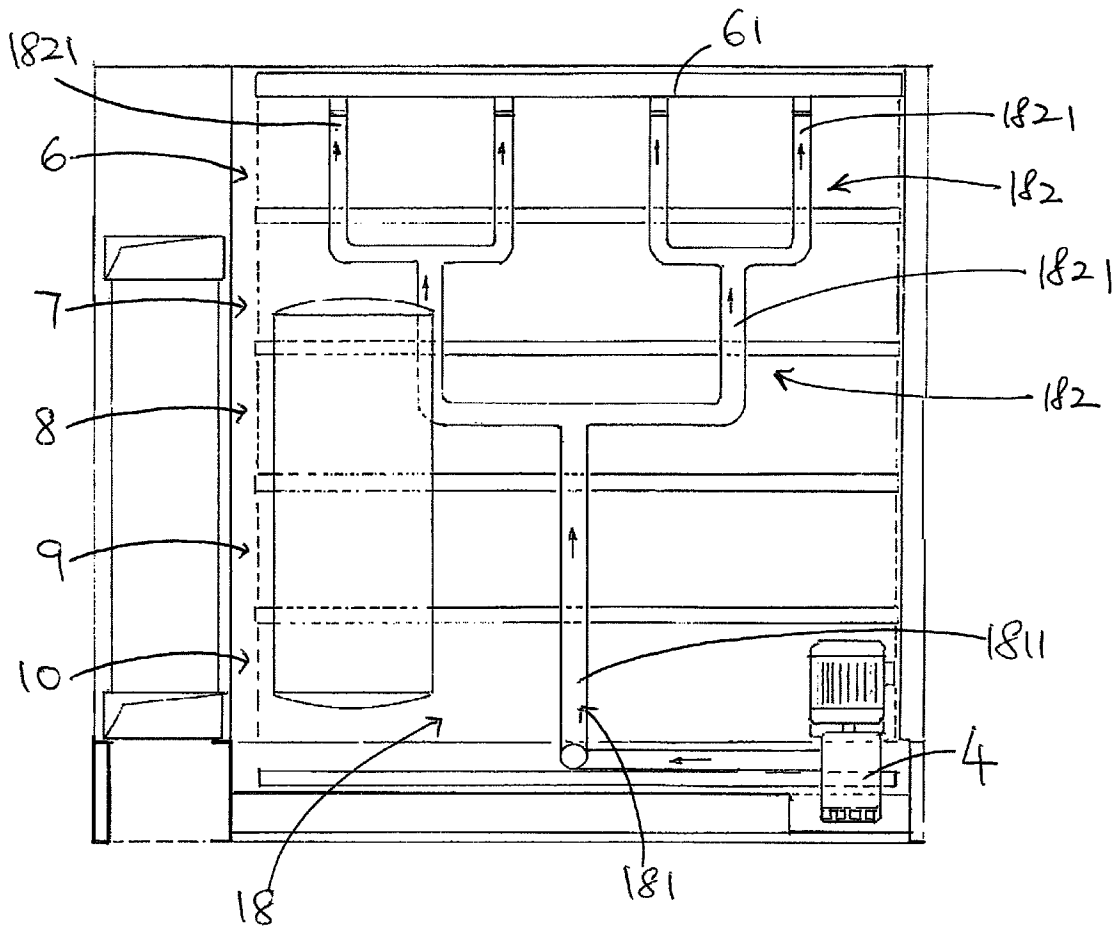
FIG. 4 is a sectional view of the air conditioning and heat pump system along plane B-B of FIG. 3, illustrating that the multiple-effect evaporative condenser has five cooling units.

Referring to FIG. 4 of the drawings, each of the multiple-effect evaporative condensers 5 further comprises a pumping pipe assembly 18 connecting the pumping device 4 and the first cooling unit 6. Specifically, the pumping pipe assembly 18 has one end connected to the pumping device 4 and extends upwardly along the corresponding multiple-effect evaporative condenser 5 for guiding the cooling water to flow into the first water collection basin 61 of the first cooling unit 6. The pumping pipe assembly 18 has a main piping section 181 comprising a main pipe 1811, and a plurality of branch piping sections 182 each of which has at least one pumping pipe 1821 extended from the main pipe 1811 or a corresponding pumping pipe 1821 of the lower branch piping section 181.

The pumping pipe assembly 18 has one main piping section 181 and a first branch piping section 182 upwardly extended from the main piping section 181, and a second branch piping section 182 upwardly extended from the first branch piping section 182. The first branch piping section 182 has two branch pipes 1821 bifurcated from the main pipe 1811, while the second branch piping section 182 has four branch pipes 1821, two of which are extended from one of the branch pipes 1821 of the first branch piping section 182, while the other two branch pipes 1821 are extended from another branch pipe 1821 of the first branch piping section 182.

It is important to note that the number of branch piping sections 182 depend on the height and length of the multiple-effect evaporative condenser 5 and can be varied according to different circumstances. The purpose of the pumping pipe assembly 18 is to control the flow rate of the cooling water and to allow the cooling water to be evenly and controllably distributed along a longitudinal length of the first water collection basin 61. As one may appreciate, each of the branch pipes 1821 is extended from a corresponding branch pipe 1821 of a lower branch piping section 182 or the main pipe 1811, so that the flow rate of the cooling water gradually reduces when the cooling water travels up along the pumping pipe assembly 18.

Referring to FIG. 5 of the drawings, two multiple-effect evaporative condensers 5 are illustrated. For the sake of clarity, the two multiple-effect evaporative condensers 5 are named first multiple-effect evaporative condenser 5 and second multiple-effect evaporative condenser 5 in the following descriptions. The first and the second multiple-effect evaporative condensers 5 are structurally identical and are spacedly accommodated in the outer housing 30 in such a manner that their air outlet sides 52 face each other while the air inlet sides 51 face the evaporator units 2 respectively.

The cooling water is pumped by the pumping device 4 to flow into the first water collection basin 61 of the first cooling unit 6 through the pumping pipe assembly 18. The cooling water is arranged to perform heat exchange with the refrigerant flowing through the first heat exchanging pipes 62 and absorb a certain amount of heat. The cooling water is then allowed to flow into the first fill material unit 63 where it forms thin water film under the influence of gravity. The water film performs heat exchange with the air draft so that heat is extracted from the cooling water to the ambient air. The cooling water is then guided to flow into the second water collection basin 71 of the second cooling unit 7 and performs another cycle of heat exchange with the refrigerant flowing through the second heat exchanging pipes 72 and in the second fill material unit 73. The cooling water is guided to sequentially flow through first through fifth cooling unit 6, 7, 8, 9, 10 to absorb heat from the refrigerant flowing through the various heat exchanging pipes. The absorbed heat is subsequently extracted to ambient air in the various fill material units.

As shown in FIG. 8 of the drawings, each of the multiple-effect evaporative condensers 5 further comprises a bottom cooling unit 300 provided underneath the fifth cooling unit 10 for providing additional cooling of the refrigerant. The bottom cooling unit 300 comprises a guiding member 301, and a plurality of bottom heat exchanging pipes 302 immersed in the bottom water collection basin 100. The refrigerant passing through the bottom heat exchanging pipes 302 are arranged to perform heat exchange with the cooling water contained in the bottom water collection basin 100.

The guiding member 301 has a blocking portion 3011, an inclined guiding portion 3012, and a horizontal guiding portion 3013 extended between the blocking portion 3011 and the inclined guiding portion 3012. The blocking portion 3011 is upwardly extended from one end of the horizontal guiding portion 3013, while the inclined guiding portion 3012 is downwardly extended from another end of the horizontal guiding portion 3013. The guiding member 301 is positioned underneath the fifth cooling unit 10 and above the bottom water collection basin 100. Optimally, the horizontal guiding portion 3013 should be positioned above the cooling water level by approximately 3 mm to 6 mm. When cooling water falls from the fifth cooling unit 10 and reaches the horizontal guiding portion 3013, the cooling water is blocked from falling into the bottom water collection basin 100 from the end where the blocking portion 3011 is positioned because the cooling water is blocked by the blocking portion 3011. Thus, the cooling water is only allowed to fall into the bottom water collection basin 100 via the inclined guiding portion 3012 which is inclinedly and downwardly extended from another end of the horizontal guiding portion 3013.

In the preferred embodiment, the inclined guiding portion 3012 is provided at the air inlet side 51 of the multiple-effective evaporative condenser 5 while the blocking portion 3011 is provided at the air outlet side 52 thereof. Thus, the cooling water is guided to fall into the bottom water collection basin 100 at an outer side (i.e. the same side as the air inlet side 51) thereof. As a result, the temperature of the cooling water contained in the bottom water collection basin 100 is uneven. Since the bottom heat exchanging pipes 302 are immersed in the cooling water which falls into the bottom water collection basin 100 at one side only (i.e. outer side), the relatively cool cooling water (from the fifth cooling unit 10) is guided or forced to pass through the bottom heat exchanging pipes 302 and absorb heat from the refrigerant passing therethrough. The temperature of the cooling water increases as it absorbs heat from the refrigerant. From simple physics, one may appreciate that water having a higher temperature tends to move upward in a contained space. Thus, when the cooling water absorbs heat from the bottom heat exchanging pipes 302, it tends to move upward in the bottom water collection basin 100.

Each of the multiple-effect evaporative condensers 5 further comprises a pumping tank 19 communicated with the bottom water collection basin 100. The pumping tank 19 is positioned adjacent to an inner side (i.e. the same side as the air outlet side 52 of the multiple-effect evaporative condenser 5) of the bottom water collection basin 100 such that the relatively warmer cooling water may flow into the pumping tank 19 which also accommodate the pumping device 4. As shown in FIG. 8 of the drawings, the bottom water collection basin 100 and the pumping tank 19 share one common sidewall 191 so that the cooling water contained in the bottom water collection basin 100 is allowed to flow into the pumping tank 19 by flowing over the common sidewall 191. The cooling water then flows into the pumping tank 19 which pumps the cooling water back to the first cooling unit 6 of the relevant multiple-effect evaporative condenser 5.

As shown in FIG. 6 of the drawings, the first water collection basin 61 has a first stabilizing compartment 611 connected to the pumping pipe assembly 18, a first heat exchanging compartment 612 provided adjacent to and communicated with the first stabilizing compartment 611 via a first water channel 613, wherein the first heat exchanging pipes 62 are immersed in the first heat exchanging compartment 612. The cooling water pumped by the pumping device 4 is guided to flow into the first stabilizing compartment 611. When the stabilizing compartment 611 is filled with a predetermined amount of cooling water which reaches the first water channel 613, the cooling water flows into the heat exchanging compartment 612 through the first water channel 613. The purpose of the first stabilizing compartment 611 is to provide a buffer zone for controlling the flow rate and pressure of the cooling water. These parameters affect the performance of the heat exchanging process between the cooling water and the first heat exchanging pipes 62.

It is worth mentioning that the first water channel 613 should be elongated in shape and extend along a longitudinal direction of the first water collection basin 61 so as to allow the cooling water to evenly flow into the first heat exchanging compartment 612 along a longitudinal direction of the first heat exchanging pipes 62. As a result, the cooling water enters the first heat exchanging compartment 612 at an even flow rate along the entire length of the first heat exchanging pipes 62. This structural arrangement also ensures that the first heat exchanging pipes 62 are immersed in the cooling water in its entirety.

The first water collection basin 61 has a first inner sidewall 614, a first outer sidewall 615, a first partitioning wall 616, and a first bottom plate 617, and a first passage plate 618. The first partitioning wall 616 is provided between the first inner sidewall 614 and the first outer sidewall 615, and divides the first water collection basin 61 into the first stabilizing compartment 611 and the first heat exchanging compartment 612, wherein the first water channel 613 is formed on the first partitioning wall 616 along a longitudinal direction thereof. The first stabilizing compartment 611 is formed between the first inner sidewall 614, the first partitioning wall 616, and the first bottom plate 617. The first heat exchanging compartment 612 is formed by the first partitioning wall 616, the first outer sidewall 615, and the first passage plate 618.

Figure 11:
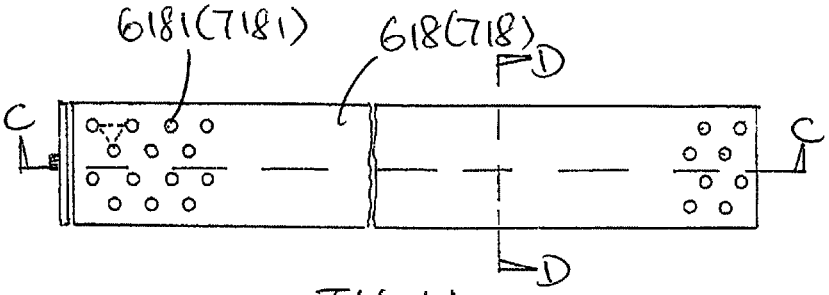
FIG. 11 is a plan view of a first passage plate of the first cooling unit according to the preferred embodiment of the present invention.

The first passage plate 618 has a plurality of first passage holes 6181 for allowing the cooling water contained in the first heat exchanging compartment 612 to fall into the first fill material unit 63. Referring to FIG. 11 of the drawings, the first passage holes 6181 are distributed along the first passage plate 618 in a predetermined array, wherein a center of each of the first passage holes 6181 in a particular row is arranged not to align with that of the first passage holes 6181 in the next row. Moreover, each two adjacent first passage holes 6181 of an upper row thereof is arranged to form a triangular distribution with a corresponding first passage hole 6181 of the adjacent row of the first passage holes 6181, as shown in FIG. 11 of the drawings. The first passage holes 6181 all have identical shape and size.

Figure 9:
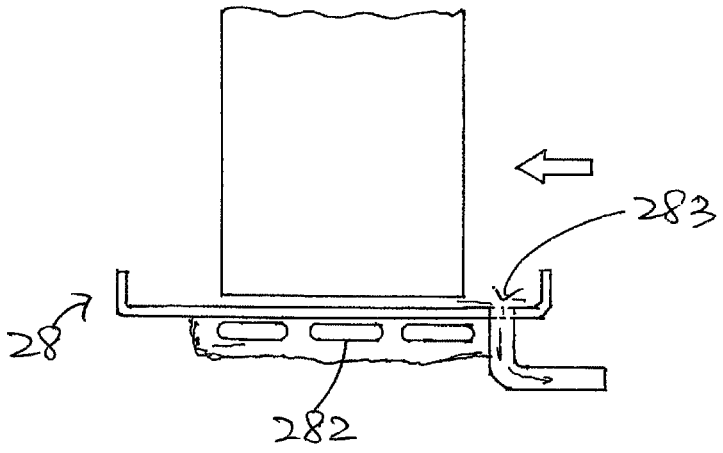
FIG. 9 is a schematic diagram of a frost removal arrangement of the air conditioning and heat pump system according to the preferred embodiment of the present invention.
Figure 10:
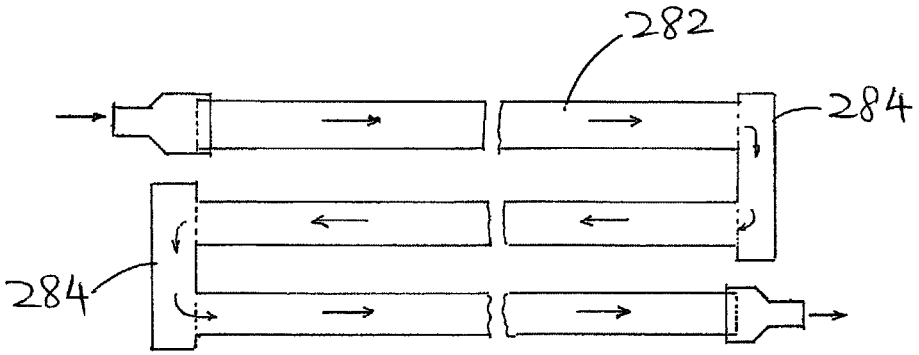
FIG. 10 is a schematic diagram of the heat exchanging pipes of one frost removal arrangement according to the preferred embodiment of the present invention.

Referring to FIG. 8 to FIG. 10 of the drawings, the air conditioning and heat pump system further comprises two frost removal arrangements 28 provided underneath the evaporator units 2 respectively for preventing the formation of frost when the present invention is operated under very cold weather. Each of the auxiliary frost removal arrangements 28 comprises a frost water collection basin 281 provided underneath a corresponding evaporator unit 2, a plurality of heat exchanging pipes 282 provided underneath the frost water collection basin 281, and a water discharge outlet 283 provided on the frost water collection basin 281. When the air conditioning and heat pump system operates under very cold weather (such as −5° C. to −20° C.), a frost removal cycle (described below) may be needed and the frost formed on the evaporator unit 2 will be melted and the resulting water collected in the frost water collection basin 281.

Furthermore, since the air conditioning and heat pump system operates under a very cold weather condition, the water collected in the frost water collection basin 281 will eventually become ice. This phenomenon is not desirable because the formation of ice will block the water discharge outlet 283 which is responsible for drainage of the water in the frost water collection basin. As a result, the heat exchanging pipes 282 are connected to the relevant components of the air conditioning and heat pump system (described below) so that superheated or vaporous refrigerant is guided to flow through the heat exchanging pipes 282. The refrigerant flowing through the heat exchanging pipes 282 is arranged to perform heat exchange with the frost water collection basin 281 so as to maintain a predetermined temperature on the part of the frost water collection basin 281 and to prevent the water collected in it from becoming ice. The structure of each of the heat exchanging pipes 282 of the auxiliary frost removal arrangements 28 is identical to that of the first through fifth heat exchanging pipes (identified above and fully described below).

Each of the frost removal arrangements 28 further comprises a plurality of (at least one) refrigerant guider pipes 284 connected between the corresponding end of each two heat exchanging pipes 282 respectively so as to guide the refrigerant to flow in the heat exchanging pipes 282 in a predetermined manner. As shown in FIG. 10 of the drawings, there are altogether three heat exchanging pipes 282. Refrigerant is first guided to flow through first of the three heat exchanging pipes 282 and then enters the corresponding refrigerant guider pipe 284, which guides the refrigerant to flow into the another heat exchanging pipe 282. The refrigerant flowing through this second heat exchanging pipe 282 is then guided to flow into another refrigerant guider pipe 284 which guides the refrigerant to flow into the last heat exchanging pipe 282. Finally, the refrigerant is then guided to leave the frost removal arrangement 28.

Referring to FIG. 12 to FIG. 16 of the drawings, each of the multiple-effect evaporative condensers 5 comprises a flow control mechanism 17 which comprises at least one control plate 171 movably provided underneath the first passage plate 618 of the first water collection basin 61, and at least one driving member 172 connected to the first control plate 171 for driving the control plate 171 to move in a horizontal and reciprocal manner. The control plate 171 has a plurality of control holes 1711 spacedly distributed thereon. The number, size, and shape of the control holes 1711 are identical to those of the first passage holes 6181. Moreover, centers of the first passage holes 6181 are normally aligned with those of the control holes 1711 respectively. The flow control mechanism 17 further comprises a plurality of securing members 173 mounted on the first water collection basin 61 and is arranged to normally exert an upward biasing force toward the control plate 171 so as to maintain a predetermined distance between the control plate 171 and the first passage plate 618.

In this preferred embodiment, the driving member 172 comprises an adjustment screw adjustably connected between the first water collection basin 61 and the control plate 171 for driving the control plate 171 to move in a horizontal and reciprocal manner.

Figure 12:
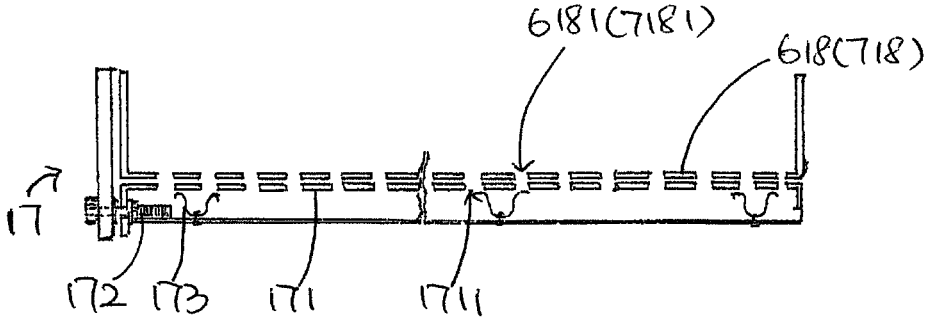
FIG. 12 is a sectional side view of a flow control mechanism of the multiple-effective evaporative condenser along plane C-C of FIG. 11, illustrating that first passage holes and first control holes are substantially aligned and overlapped respectively.
Figure 13:
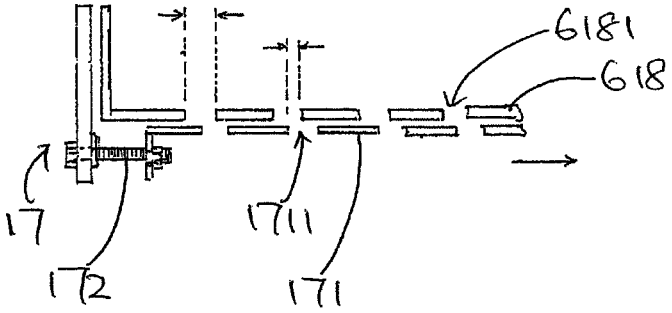
FIG. 13 is another schematic diagram of the flow control mechanism of the multiple-effective evaporative condenser according to the preferred embodiment of the present invention, illustrating that the first passage holes and the first control holes start to offset.

As shown in FIG. 12 of the drawings, when each of the first passage holes 6181 is aligned or substantially overlap with a corresponding control hole 1711, the cooling water in the first water collection basin 61 may pass through the first passage plate 618 and the control plate 171 at maximum flow rate. However, as shown in FIG. 13 of the drawings, when the control plate 171 is driven to move horizontally, the control holes 1711 and the first passages holes 6181 no longer align and flow rate of the cooling water passing through the control plate 171 and the first passage plate 618 will decrease. When the control plate 171 is moved such that each of the control holes 1711 blocks the corresponding first passage hole 6181, the flow rate of the cooling water is at its minimum, which is approximately one-third of the maximum flow rate of the cooling water.

The purpose of the flow control mechanism 17 is to control the flow rate of the cooling water flowing from the first cooling unit 6 to the second cooling unit 7, or from an upper cooling unit to a lower cooling unit. The controlled flow rate ensures that the heat exchanging pipes, such as the second heat exchanging pipes 72, can be fully immersed in the cooling water so as to perform the heat exchange process in the most effective and efficient manner.

Figure 14:
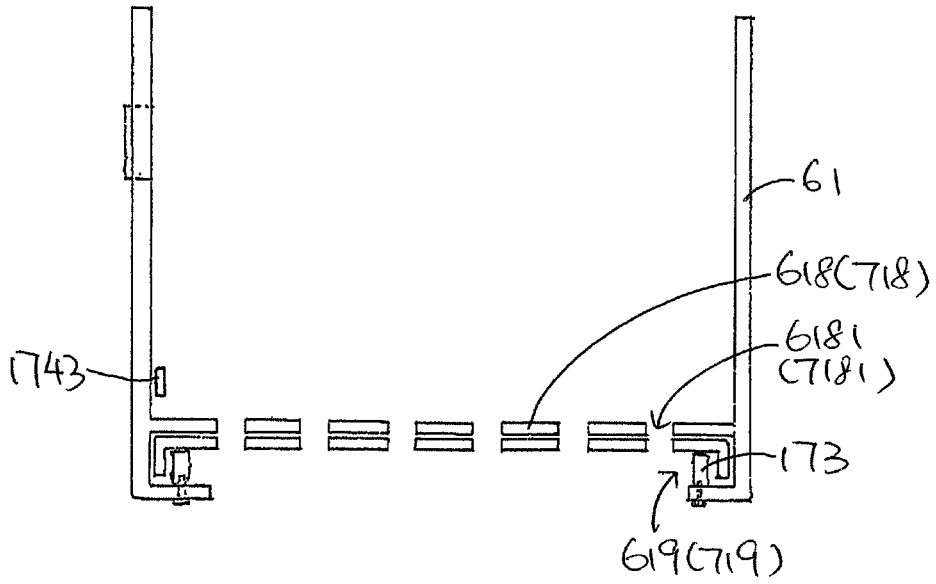
FIG. 14 is a sectional side view of a flow control mechanism of the multiple-effective evaporative condenser along plane D-D of FIG. 11.

Referring to FIG. 14 of the drawings, the first water collection basin 61 further has a pair of first securing slots 619 formed at lower portions of the first partitioning wall 616 and the first outer sidewall 615 respectively. Each of the first securing slots 619 is elongated along a longitudinal direction of the first water collection basin 61, wherein the securing members 173 are mounted in the first securing slots 619 respectively. In this preferred embodiment, each of the securing members 173 is a resilient element which normally exerts an upward biasing force against the control plate 171.

It is worth mentioning that the first water collection basin 61 (or other water collection basins used in the present invention) can be manufactured as an integral body for ensuring maximum structural integrity and minimum manufacturing cost. The material used may be plastic material or stainless steel.

Figure 15:
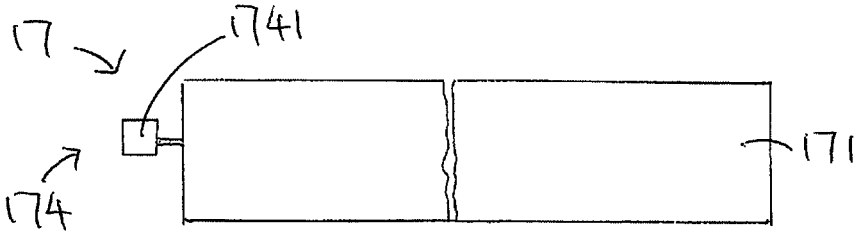
FIG. 15 is a schematic diagram of an automated control system of the flow control mechanism according to the preferred embodiment of the present invention.
Figure 16:
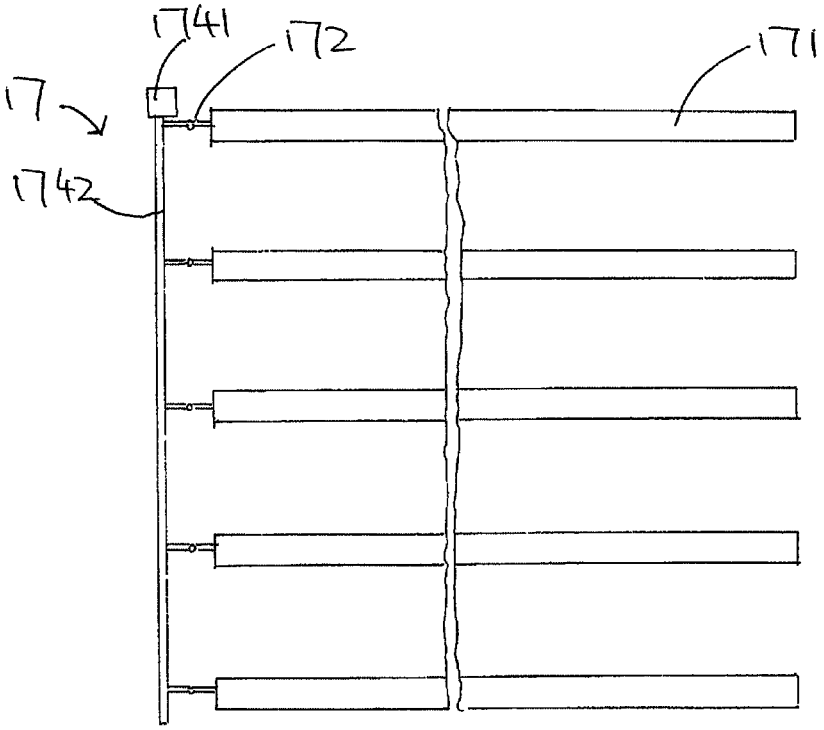
FIG. 16 is another schematic diagram of the automated control system of the flow control mechanism according to the preferred embodiment of the present invention.

Referring to FIG. 14 to FIG. 16 of the drawings, the flow control mechanism 17 further comprises an automated control system 174 operatively connected to at least one driving member 172. The automated control system 174 comprises a central control unit 1741, a connecting member 1742 connected between the central control unit 1741 and the driving member 172, and a sensor 1743 provided in the first water collection basin 61 and electrically connected to the central control unit 1741.

The sensor 1743 detects the water level in the first water collection basin 61 and sends a signal to the central control unit 1741, which is pre-programmed to respond to the sensor signal. The central control unit 1741 is then arranged to drive the connecting member 1742 to move horizontally so as to drive the driving member 172 to move in the same direction for controlling the flow rate of the cooling water flowing through the first passage plate 618.

Referring back to FIG. 6 of the drawings, the first cooling unit 6 further comprises a first water distributing panel 610 having a plurality of distribution openings 6101 mounted between the first water collection basin 61 and the first fill material unit 63 of the first cooling unit 6 for allowing the cooling water flowing from the first water collection basin 61 to be evenly distributed into the first fill material unit 63 along a transverse direction thereof. The purpose of the first water distributing panel 610 is to ensure proper formation of the water film in the first fill material unit 63 and optimal heat exchange performance between the water film and the ambient air.

Furthermore, each of the evaporative condensers 5 further comprises at least one filter member 15 supported between the first cooling unit 6 and the second cooling unit 7 for filtering unwanted substances from the cooling water flowing from the first cooling unit 6 to the second cooling unit 7, as shown in FIG. 7 of the drawings.

As shown in FIG. 7 of the drawings, the second water collection basin 71 has a second heat exchanging compartment 712, wherein the second heat exchanging pipes 72 are immersed in the second heat exchanging compartment 712. The cooling water coming from the first cooling unit 6 is guided to flow into the second heat exchanging compartment 712 via the filter member 15.

The second water collection basin 71 has a second inner sidewall 714, a second outer sidewall 715, and a second passage plate 718. The second heat exchanging compartment 712 is defined within the second inner sidewall 714, the second outer sidewall 715, and the second passage plate 718. The second passage plate 718 has a plurality of second passage holes 7181 for allowing the cooling water contained in the second heat exchanging compartment 712 to fall into the bottom water collection basin 100 or an additional cooling unit, such as the third cooling unit 8, when the multiple-effective evaporative condenser 5 has more than two cooling units. Referring to FIG. 11 of the drawings, the second passage holes 7181 are distributed along the second passage plate 718 in a predetermined array, wherein a center of each of the second passage holes 7181 in a particular row is arranged not to align with that of the second passage holes 7181 in the next row. Moreover, each two adjacent second passage holes 7181 of an upper row thereof is arranged to form a triangular distribution with a corresponding second passage hole 7181 of the adjacent row of the second passage holes 7181 as shown in FIG. 12 of the drawings. The second passage holes 7181 all have identical shape and size. These structures are identical to that of the first passage plate 618, and the first passage holes 6181.

In this preferred embodiment, the flow control mechanism 17 comprises a plurality of control plates 171 provided underneath the first passage plate 618 and the second passage plate 718, and a plurality of driving members 172 connected to the control plates 171 respectively for driving the control plates 171 to move in a horizontal and reciprocal manner respectively, as shown in FIG. 12 and FIG. 13 of the drawings. Generally speaking, the flow control mechanism 17 comprises the same number of control plates 171 as that of the cooling units 6, 7, 8, 9, 10. In other words, when the multiple-effective evaporative condensers 5 comprises first through fifth cooling units 6, 7, 8, 9, 10, the flow control mechanism will comprise five control plates 171 and five driving members 172. The structure of each of the control plates 171 and the driving members 172 is identical and has been described above. This structure is illustrated in FIG. 16 of the drawings.

Referring to FIG. 14 of the drawings, the second water collection basin 71 further has a pair of second securing slots 719 formed at lower portions of the second inner side wall 714 and the second outer sidewall 715 respectively. Each of the second securing slots 719 is elongated along a longitudinal direction of the second water collection basin 71, wherein the corresponding securing members 173 are mounted in the second securing slots 719 respectively. Again, in this preferred embodiment, each of the securing members 173 is a resilient element which normally exert an upward biasing force against the corresponding control plate 171.

As mentioned above and as shown in FIG. 16 of the drawings, the flow control mechanism 17 may be operated through the automated control system 174 operatively connected to all the driving members 172 for electrically and automatically controlling the movement of all of the driving members and ultimately the control plates 171.

Referring back to FIG. 7 of the drawings, the second cooling unit 7 further comprises a second water distributing panel 710 having a plurality of distribution openings 7101 mounted between the second water collection basin 71 and the second fill material unit 73 of the second cooling unit 7 for allowing the cooling water flowing from the second water collection basin 71 to be evenly distributed into the second fill material unit 73 along a transverse direction thereof. The purpose of the second water distributing panel 710 is to ensure proper formation of the water film in the second fill material unit 73 and optimal heat exchange performance between the water film and the ambient air.

Furthermore, each of the evaporative condensers 5 further comprises a plurality of filter members 15 supported between each two cooling units for filtering unwanted substances from the cooling water flowing from an upper cooling unit to an immediately lower cooling unit.

Figure 17:
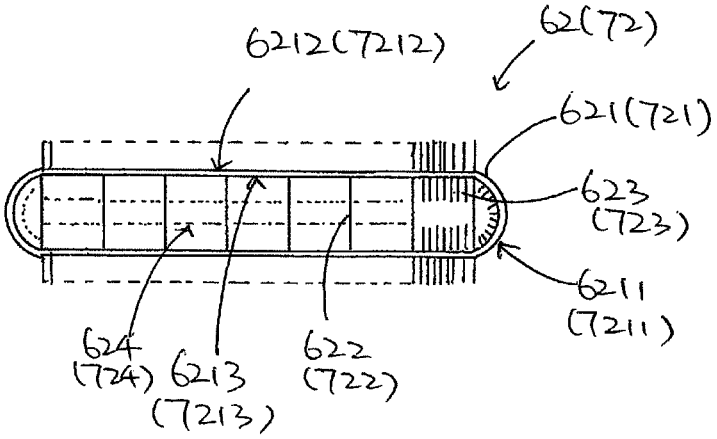
FIG. 17 is a sectional side view of a heat exchanging pipe of the multiple-effective evaporative condenser according to a preferred embodiment of the present invention.

Referring to FIG. 17 of the drawings, each of the first heat exchanging pipes 62 comprises a first pipe body 621 and a plurality of first retention members 622 spacedly formed in the first pipe body 621, and a plurality of first heat exchanging fins 623 extended from an inner surface 6213 of the pipe body 621 along the entire length of the first heat exchanging pipe 62. Specifically, the first pipe body 621 has two curved side portions 6211 and a substantially flat mid portion 6212 extending between the two curved side portions to form rectangular cross sectional shape at the mid portion 6212 and two semicircular cross sectional shapes at two curved side portions 6211 of the first heat exchanging pipe 62.

Furthermore, the retention members 622 are spacedly distributed in the flat mid portion 6212 along a transverse direction of the corresponding pipe body 621 so as to form a plurality of first pipe cavities 624. Each of the retention members 622 has a predetermined elasticity for reinforcing the structural integrity of the corresponding first heat exchanging pipe 62. On the other hand, each of the first heat exchanging fins 623 are extended from an inner surface of the first pipe body 621. The first heat exchanging fins 623 are spacedly and evenly distributed along the inner surface 6213 of first pipe body 621 for enhancing heat exchange performance between the refrigerant flowing through the corresponding first heat exchanging pipe 62 and the cooling water.

On the other hand, the second heat exchanging pipes 72 are structurally identical to the first heat exchanging pipes 62. So, also referring to FIG. 17 of the drawings, each of the second heat exchanging pipes 72 comprises a second pipe body 721 and a plurality of second retention members 722 spacedly formed in the second pipe body 721, and a plurality of second heat exchanging fins 723 extended from an inner surface 7213 of the pipe body 721 along the entire length of the second heat exchanging pipe 72. Specifically, the second pipe body 721 has two curved side portions 7211 and a substantially flat mid portion 7212 extending between the two curved side portions to form rectangular cross sectional shape at the mid portion 7212 and two semicircular cross sectional shapes at two curved side portions 721 of the second heat exchanging pipe 72.

Furthermore, the retention members 722 are spacedly distributed in the flat mid portion 7212 along a transverse direction of the corresponding pipe body 721 so as to form a plurality of second pipe cavities 724. Each of the retention members 722 has a predetermined elasticity for reinforcing the structural integrity of the corresponding second heat exchanging pipe 72. On the other hand, each of the second heat exchanging fins 723 are extended from an inner surface of the second pipe body 721. The second heat exchanging fins 723 are spacedly and evenly distributed along the inner surface 7213 of second pipe body 721 for enhancing heat exchange performance between the refrigerant flowing through the corresponding second heat exchanging pipe 72 and the cooling water.

It is worth mentioning that when the multiple-effect evaporative condenser 5 comprises many cooling units, such as the above-mentioned first through fifth cooling units 6, 7, 8, 9, 10, the third through fifth heat exchanging pipes 82, 92, 102 are structurally identical to the first heat exchanging pipes 62 and the second heat exchanging pipes 72 described above. Moreover, each of the heat exchanging pipes 282 of the frost removal arrangements 28 is also structurally identical to that of the first through fifth heat exchanging pipes 62, 72, 82, 92, 102.

According to the preferred embodiment of the present invention, each of the first through fifth heat exchanging pipes 62, 72, 82, 92, 102 and the heat exchanging pipes of the frost removal arrangements 28 are configured from aluminum which can be recycled and reused very conveniently and economically. In order to make the heat exchanging pipes to resist corrosion and unwanted oxidation, each of the heat exchanging pipes 62, 72, 82, 92, 102, 282 has a thin oxidation layer formed on an exterior surface and an interior surface thereof for preventing further corrosion of the relevant heat exchanging pipe. The formation of this thin oxidation layer can be by anode oxidation method.

Moreover, each of the heat exchanging pipes 62, 72, 82, 92, 102, 282 may also have a thin layer of polytetrafluoroethylene formed on an exterior surface thereof to prevent unwanted substances from attaching on the exterior surfaces of the heat exchanging pipes 62, 72, 82, 92, 102, 282.

The use of aluminum for the heat exchanging pipes 62, 72, 82, 92, 102, 282 allows reduction of manufacturing cost by approximately 50% as compared with traditional heat exchanging pipes, which are configured from copper. Possible corrosion problem is effectively resolved by the introduction of the thin oxidation layer on an exterior surface and an interior surface of each of the heat exchanging pipes 62 (72) (82) (92) (102) (282) and the addition of the thin layer of thin layer of polytetrafluoroethylene on the exterior surfaces of the heat exchanging pipes 62 (72) (82) (92) (102) (282).

Figure 18:
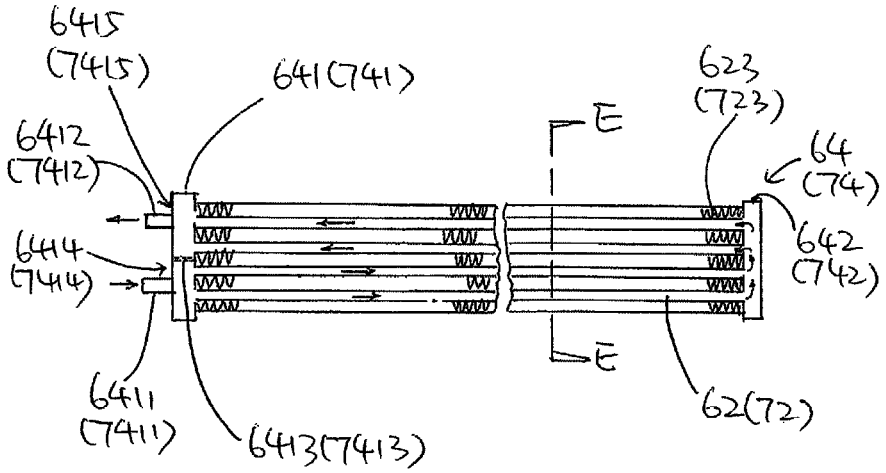
FIG. 18 is a schematic diagram of the first heat exchanging pips of the first cooling unit according to the preferred embodiment of the present invention.
Figure 19:
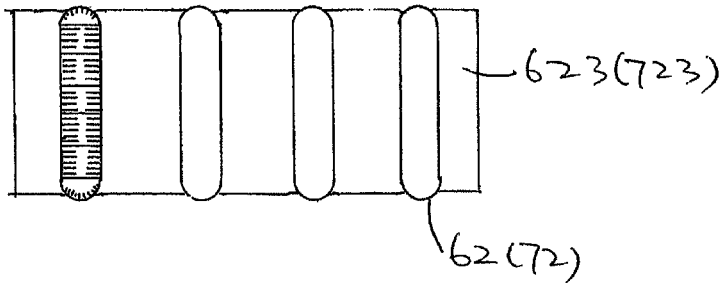
FIG. 19 is a sectional side view along plane E-E of FIG. 18.

Referring to FIG. 18 to FIG. 19 of the drawings, the first cooling unit 6 further comprises a first guiding system 64 connected to the first heat exchanging pipes 62 to divide the first heat exchanging pipes 62 into several piping groups so as to guide the refrigerant to flow through the various piping groups in a predetermined order. Specifically, the first guiding system 64 comprises a first inlet collection pipe 641 and a first guiding pipe 642, wherein each of the first heat exchanging pipes 62 has one end connected to first inlet collection pipe 641, and another end connected to the first guiding pipe 642. As shown in FIG. 18 of the drawings, the first inlet collection pipe 641 has a first fluid inlet 6411, a first fluid outlet 6412, and a divider 6413 provided in the first inlet collection pipe 641 to divide the first inlet collection pipe 641 into an inlet portion 6414 and an outlet portion 6415. The divider 6413 prevents fluid from passing from one side of the divider 6413 to the other side of the divider 6413 (i.e. the fluid is prevented from passing from the first inlet portion 6414 to the first outlet portion 6415). The first fluid inlet 6411 is formed on the first inlet portion 6414, while the first fluid outlet 6412 is formed on the first outlet portion 6415.

According to the preferred embodiment of the present invention, there are altogether four first heat exchanging pipes 62 which are divided into two piping groups. The refrigerant enters the first inlet collection pipe 641 through the first fluid inlet 6411. The first piping group has two first heat exchanging pipes 62 which are connected to the first inlet portion 6414 while the second piping group has another two of the first heat exchanging pipes 62 which are connected to the first outlet portion 6415. Thus, the refrigerant entering the first inlet collection pipe 641 is guided to flow through the two heat exchanging pipes 62 of the first piping group. The refrigerant then leaves the two corresponding first heat exchanging pipes 62 and enters the first guiding pipe 642. The refrigerant flowing in the first guiding pipe 642 is allowed to enter the other two first heat exchanging pipes 62 of the second piping group. The refrigerant is then guided to flow through the two first heat exchanging pipes 62 of the second piping group. The refrigerant then exits the first inlet collection pipe 641 through the first fluid outlet 6412. The refrigerant flowing through the first heat exchanging pipes 62 are arranged to perform heat exchange with the cooling water passing through the first cooling unit 6.

In addition, the first guiding system 64 further comprises a plurality of first heat exchanging fins 623 extended between each two adjacent first heat exchanging pipes 62 for substantially increasing a surface area of heat exchange between the first heat exchanging pipes 62 and the cooling water, and for reinforcing a structural integrity of the first guiding system 64. These first heat exchanging fins 623 may be integrally extended from an outer surface of the first heat exchanging pipes 62, or externally attached or welded on the outer surfaces of the first heat exchanging pipes 62.

Figure 21:
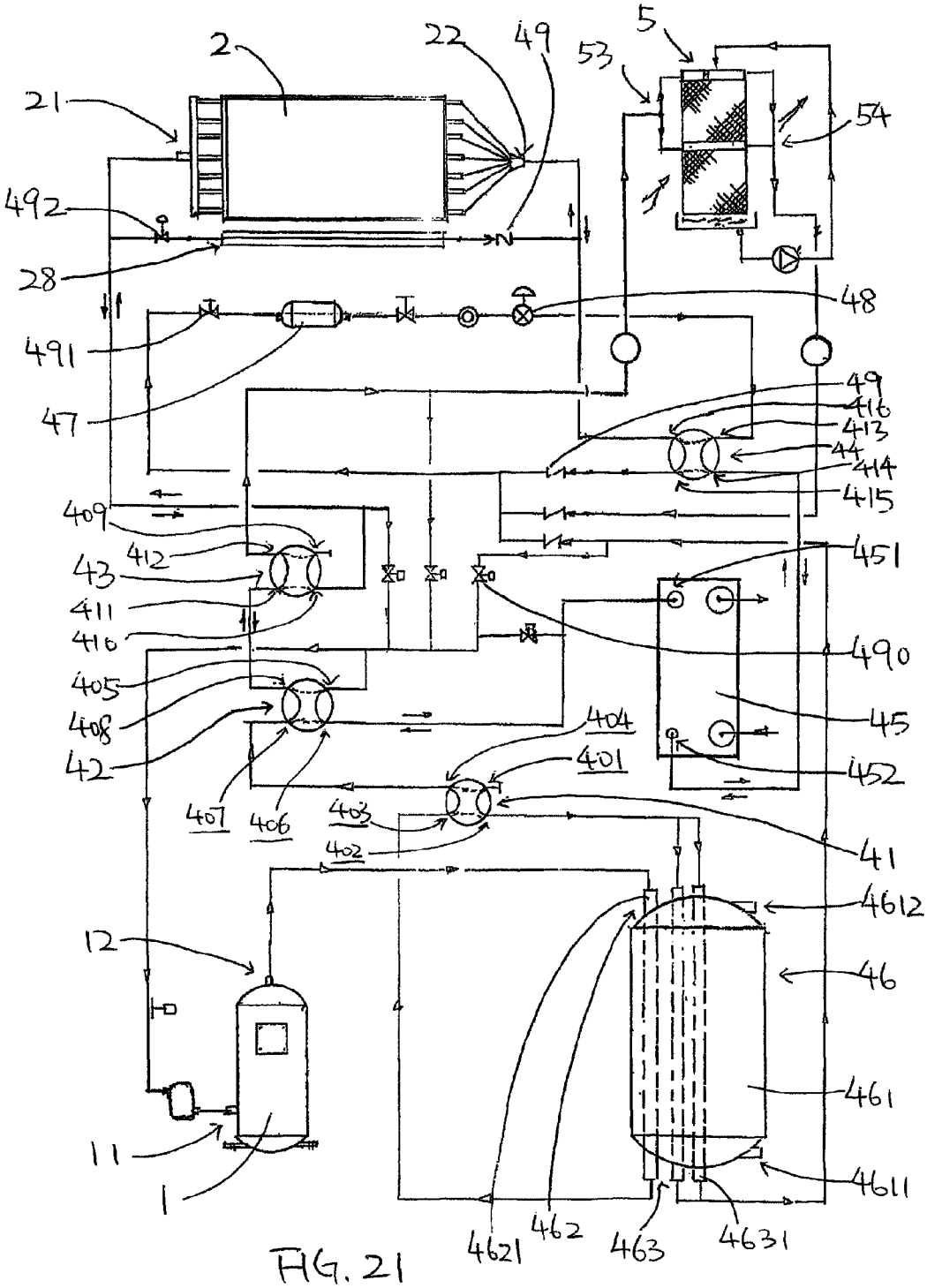
FIG. 21 is a system diagram of various components of the air conditioning and heat pump system according to the preferred embodiment of the present invention.

Also referring to FIG. 18 to FIG. 19 of the drawings, the second cooling unit 7 further comprises a second guiding system 74 connected to the second heat exchanging pipes 72 to divide the second heat exchanging pipes 72 into a predetermined number of piping groups, and for guiding the refrigerant to flow through the second heat exchanging pipes 72 in a predetermined order. The structure of the second guiding system 74 is identical to that of the first guiding system 64. Thus, the second guiding system 74 comprises a second inlet collection pipe 741 and a second guiding pipe 742, wherein each of the second heat exchanging pipes 72 has one end connected to second inlet collection pipe 741, and another end connected to the second guiding pipe 742. As shown in FIG. 21 of the drawings, the second inlet collection pipe 741 has a second fluid inlet 7411, a second fluid outlet 7412, and a second divider 7413 provided in the second inlet collection pipe 741 to divide the second inlet collection pipe 741 into an inlet portion 7414 and an outlet portion 7415. The second divider 7413 prevents fluid from passing from one side of the second divider 7413 to the other side of the second divider 7413 (i.e. the fluid is prevented from passing from the second inlet portion 7414 to the second outlet portion 7415). The second fluid inlet 7411 is formed on the second inlet portion 7414, while the second fluid outlet 7412 is formed on the second outlet portion 7415.

Again, there are altogether four second heat exchanging pipes 72 which are divided into two piping groups. The refrigerant enters the second inlet collection pipe 741 through the second fluid inlet 7411. The first piping group has two of the second heat exchanging pipes 72 which are connected to the second inlet portion 7414 while another piping group has the remaining two of the second heat exchanging pipes 72 which are connected to the second outlet portion 7415. Thus, the refrigerant entering the second inlet collection pipe 741 is guided to flow through the two heat exchanging pipes 72 which are connected to the second inlet portion 7414 (i.e. the first piping group). The refrigerant then leaves the two second heat exchanging pipes 72 and enters the second guiding pipe 742. The refrigerant flowing in the second guiding pipe 742 is allowed to enter the other two second heat exchanging pipes 72 which are connected to the second outlet portion 7415 (i.e. the second piping group). The refrigerant is then guided to flow through the two second heat exchanging pipes 72 which are connected to the second outlet portion 7415 and enters it. The refrigerant then exits the second inlet collection pipe 741 through the second fluid outlet 7412. The refrigerant flowing through the second heat exchanging pipes 72 are arranged to perform heat exchange with the cooling water passing through the second cooling unit 7.

In addition, the second guiding system 74 further comprises a plurality of second heat exchanging fins 723 extended between each two adjacent second heat exchanging pipes 72 for substantially increasing a surface area of heat exchange between the second heat exchanging pipes 72 and the cooling water, and for reinforcing a structural integrity of the second guiding system 74. These second heat exchanging fins 723 may be integrally extended from an outer surface of the second heat exchanging pipes 72, or externally attached or welded on the outer surfaces of the second heat exchanging pipes 72.

It is important to mention at this stage that the above-mentioned configuration of the first guiding system 64, the second guiding system 74, the first heat exchanging pipes 62, the second heat exchanging pipes 72, and the number of piping groups are for illustrative purpose only and can actually be varied according to the circumstances in which the present invention is operated. In this preferred embodiment, there are altogether two piping groups. Moreover, the fluid inlets and fluid outlets of all of the cooling units are merged to form a central fluid inlet 53 and a central fluid outlet 54 for the evaporative cooling unit 200. The refrigerant circulates to other components of the air conditioning and heat pump system through the central fluid inlet 53 and the central fluid outlet 54.

Figure 20:
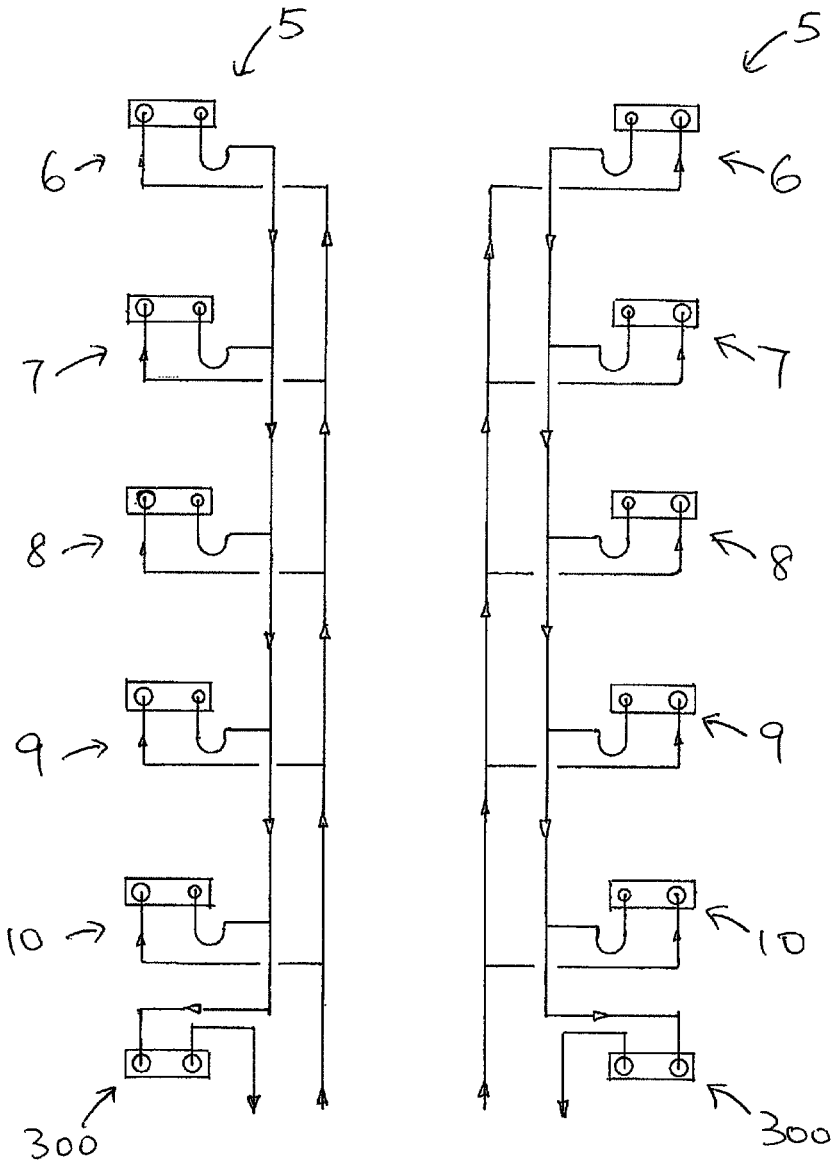
FIG. 20 is a schematic diagram of a flowing route of the refrigerant flowing through a multiple-effective evaporative condenser according to a preferred embodiment of the present invention.

FIG. 20 illustrates the flowing path of the refrigerant. Each of the cooling units 6, 7, 8, 9, 10 are connected in parallel, in which the refrigerant is guided to flow into and out of each of the cooling units 6, 7, 8, 9, 10 at the same time. Thus, the refrigerant from the each compressor unit 1 is divided into five branches which is guided to flow into the cooling units 6, 7, 8, 9, 10 respectively. After being cooled, the refrigerant from each of the cooling units 6, 7, 8, 9, 10 will be merged together again and is guided to flow to the other components of the air conditioning and heat pump system of the present invention (the details of which will be further described below).

Referring to FIG. 21 to FIG. 23 of the drawings, a detailed system diagram of the various components of the air conditioning and heat pump system according to the preferred embodiment of the present invention is illustrated. As shown in FIG. 21 of the drawings and mentioned above, the air conditioning and heat pump system of the present invention comprises two compressor units 1, two evaporator units 2, two evaporative cooling systems 5, the water heater 46, two heat exchangers 45, a plurality of drying filters 47, a plurality of expansion valves 48, a plurality of unidirectional valves 49, and a plurality of connecting valves. The air conditioning and heat pump system comprises two cooling and heating loops in which each loop comprises one compressor unit 1, one evaporator unit 2, one evaporative cooling system 200, one heat exchanger 45, a predetermined number of dryer filters 47, a predetermined number of expansion valves 48, a predetermined number of unidirectional valves 49, a predetermined number of two-way valves 490, a predetermined number of manual valves 491, and first through fourth connecting valves 41, 42, 43, 44. The two cooling and heating loops share one common water heater 46.

The air conditioning and heat pump system of the present invention may selectively operate between an air conditioning mode (for delivering cooled air in an indoor space) and a heat pump mode (for delivering warm air in the indoor space). Apart from these two modes, the present invention is also capable of producing hot water when the air conditioning mode or and heat pump mode are not in use. In other words, the user of the present invention does not need to additionally install a water heater system. The user needs to install only one single system to selectively enjoy cooled air and hot water, or heated air and hot water.

As shown in FIG. 21 of the drawings, for each of the cooling and heating loops, the compressor unit 1 has a compressor outlet 12 connected to the water heater 46, and a compressor inlet 11. The compressor inlet 11 is connected to the heat exchanger 45, the evaporative cooling system 200, and the evaporator unit 2 through the second connecting valve 42, the third connecting valve 43, the fourth connecting valve 44, a predetermined number of unidirectional valves 49, and a predetermined number of two-way valves 490. The exact connection between these components is shown in FIG. 21.

As shown in FIG. 22 and FIG. 23 of the drawings, each of the first through fourth connecting valve 41, 42, 43, 44 may operate between a normal mode and a switched mode. For the first connecting valve 41, it has first through fourth connecting port 401, 402, 403, 404. When the first connecting valve is in the normal mode, the first connecting port 401 is connected to the second connecting port 402 while the third connecting port 403 is connected to the fourth connecting port 404. When the first connecting valve 41 is in the switched mode, the first connecting port 401 is connected to the fourth connecting port 404 while the second connecting port 402 is connected to the third connecting port 403.

For the second connecting valve 42, it has fifth through eighth connecting port 405, 406, 407, 408. When the second connecting valve 42 is in the normal mode, the fifth connecting port 405 is selectively connected to the sixth connecting port 406 while the seventh connecting port 407 is connected to the eighth connecting port 408. When the second connecting valve 42 is in the switched mode, the fifth connecting port 405 is connected to the eighth connecting port 408 while the sixth connecting port 406 is connected to the seventh connecting port 407.

For the third connecting valve 43, it has ninth through twelfth connecting port 409, 410, 411, 412. When the third connecting valve 43 is in the normal mode, the ninth connecting port 409 is selectively connected to the tenth connecting port 410 while the eleventh connecting port 411 is connected to the twelfth connecting port 412. When the third connecting valve 43 is in the switched mode, the ninth connecting port 409 is connected to the twelfth connecting port 412 while the tenth connecting port 410 is connected to the eleventh connecting port 411.

For the fourth connecting valve 44, it has thirteenth through sixteen connecting port 413, 414, 415, 416. When the fourth connecting valve 44 is in the normal mode, the thirteenth connecting port 413 is selectively connected to the fourteenth connecting port 414 while the fifteenth connecting port 415 is connected to the sixteenth connecting port 416. When the fourth connecting valve 44 is in the switched mode, the thirteenth connecting port 413 is connected to the sixteenth connecting port 416 while the fourteenth connecting port 414 is connected to the fifteenth connecting port 415.

The heat exchanger 45 has a first exchanging port 451 and a second exchanging port 452 for allowing passage of the refrigerant and for communicating the heat exchanger 45 with other components of the air conditioning and heat pump system. The first exchanging port 451 is connected to the sixth connecting port 406 of the second connecting valve 42, the compressor unit 1, the water heater 45, the thirteenth connecting port 413 of the fourth connecting valve 44, and the fifteenth connecting port 415 of the fourth connecting valve 44. The second exchanging port 452 is connected to the fourteenth connecting port 414 of the fourth connecting valve 44.

On the other hand, the evaporator unit 2 has a first evaporator port 21 and a second evaporator port 22 for allowing passage of refrigerant. The first evaporator port 21 is connected to the compressor inlet 11 of the compressor unit 1, the tenth connecting port 410 of the third connecting valve 43, the fifth connecting port 405 of the second connecting valve 42, the auxiliary frost removal arrangement 28, the heat exchanger 45 and the evaporative cooling system 200. The second evaporator port 22 is connected to auxiliary frost removal arrangement 28, and the sixteenth connecting port 416 of the fourth connecting valve 44.

The evaporative cooling system 200 has a central fluid inlet 53 connected to all of the fluid inlets 6411 (7411) of all of the cooling units 6, 7, 8, 9, 10, and a central fluid outlet 54 connecting all of the fluid outlets 6412 (7412) of all of the cooling units 6, 7, 8, 9, 10 of the evaporative cooling system 200. The central fluid inlet 53 is connected to the twelfth connecting port 412 of the third connecting valve 43, the compressor inlet 11 of the compressor unit 1, and the first exchanging port 451 of the heat exchanger 45. The central fluid outlet 54 is connected to the thirteenth connecting port 413 of the fourth connecting valve 44, the fifteenth connecting port 415, the water heater 46, and the compressor inlet 12 of the compressor unit 1.

The water heater 46 comprises a heater housing 461 having a water inlet 4611 provided at a lower portion thereof, and a water outlet 4612 provided at an upper portion of the heater housing 461, a first water heating unit 462, and a second water heating unit 463. As mentioned above, a single water heater 46 is utilized for producing hot water for both cooling and heating loops.

The first water heating unit 462 comprises a plurality of heat exchanging pipes 4621 detachably attached in the heater housing 461, and is arranged to contact with the water coming from the water inlet 4611. Refrigerant is guided to flow through the heat exchanging pipes 4621 for performing heat exchange with the water so that heat in the refrigerant is extracted to the water for increasing the temperature of the water. The hot water is then guided to flow out of the water heater 46 through the water outlet 4612.

Similarly, the second water heating unit 463 comprises a plurality of heat exchanging pipes 4631 detachably attached in the heater housing 461, and is arranged to contact with the water coming from the water inlet 4611. Refrigerant is guided to flow through the heat exchanging pipes 4631 for performing heat exchange with the water so that heat in the refrigerant is extracted to the water for increasing the temperature of the water. The hot water is then guided to flow out of the water heater 46 through the water outlet 4612.

A predetermined amount of refrigerant is guided to flow through the above mentioned components for producing one of cooled air (air conditioning mode), warm air (heat pump mode) and hot water (water heater mode). When the air conditioning and heat pump system operates in air conditioning mode, superheated or vaporous refrigerant first leaves the compressor unit 1 through the compressor outlet 12. The superheated or vaporous refrigerant is guided to flow into the first water heating unit 462 of the water heater 46. A predetermined amount of heat is extracted to the water contained in the water heater 46 so as to produce hot water for the air conditioning and heat pump system. The refrigerant then leaves the water heater 46 and is guided to flow through the third connecting port 403 of the first connecting valve 41. In the air conditioning mode, the first connecting valve 41 is configured such that the third connecting port 403 is connected to the fourth connecting port 404 while the first connecting port 401 is connected to the second connecting port 402 (i.e. normal mode). Thus, the refrigerant is guided to leave the first connecting valve 41 through the fourth connecting port 404, which is connected to the seventh connecting port 407 of the second connecting valve 42.

The second connecting valve 42 is configured such that the seventh connecting port 407 is connected to the eighth connecting port 408 while the fifth connecting port 405 is connected to the sixth connecting port 406 (normal mode). As a result, the refrigerant entering the seventh connecting port 407 is guided to pass through the eighth connecting port 408, which is connected to the eleventh connecting port 411 of the third fourth-way valve 43.

The third connecting valve 43 is configured such that the eleventh connecting port 411 is connected to the twelfth connecting port 412 while the ninth connecting port 409 is connected to the tenth connecting port 410 (normal mode). Thus, the refrigerant entering the eleventh connecting port 411 is guided to pass through the twelfth connecting port 412, which is connected to the central fluid inlet 53 of the evaporative cooling system 200. The refrigerant is then cooled down and condensed by the corresponding multiple effect evaporative condenser 5 (in the manner described above) and leaves the multiple effect evaporative condenser 5 through the central fluid outlet 54. The refrigerant is then guided to pass through, sequentially, a unidirectional valve 49, a first manual valve 491, a dryer filter 47, a second manual valve 491, an expansion valve 48, and finally reaches the thirteenth connecting port 413 of the fourth connecting valve 44.

The fourth connecting valve 44 is configured such that the thirteenth connecting port 413 is connected to the fourteenth connecting port 414 while the fifteenth connecting port 415 is connected to the sixteenth connecting port 416 (normal mode). Thus, the refrigerant entering the thirteenth connecting port 413 is guided to pass through the fourteenth connecting port 414, which is connected to the second exchanging port 452 of the heat exchanger 45. The refrigerant entering the heat exchanger 45 is arranged to absorb heat from the indoor space and become vaporous again. The superheated or vaporous refrigerant is then arranged to leave the heat exchanger 45 through the first exchanging port 451, which is connected to the sixth connecting port 406 of the second connecting valve 42. The refrigerant then passes through the fifth connecting port 405 which is connected to the compressor inlet 11 of the compressor unit 10. The refrigerant then goes back to the compressor unit 10 and completes one refrigerant cycle for producing cooled air in the indoor space.

It is worth mentioning that when the air conditioning and heat pump system is in the air conditioning mode, the evaporator unit 2 and the second water heating unit 463 are idle. Residual refrigerant trapped in the evaporative unit 2 and the second water heating unit 463 must be guided to return to the main system (i.e. non-idle components) in order to prevent inadequate refrigerant circulating through the non-idle components of the air conditioning and heat pump system. According to the preferred embodiment of the present invention, residual refrigerant in the evaporator unit 2 will be guided to leave the evaporator unit 2 through a first evaporator port 21 and pass through a two-way valve 490 and merge with the refrigerant circulating through the non-idle components and going back to the compressor inlet 11 of the compressor unit 1.

On the other hand, the residual refrigerant in the second water heating unit 463 will be guided to leave the corresponding heat exchanging pipes 4631, pass through a two-way valve 490, and merge with the refrigerant circulating through the non-idle components and going back to the compressor inlet 11 of the compressor unit 1.

When the air conditioning and heat pump system operates in the heat pump mode, superheated or vaporous refrigerant first leaves the compressor unit 1 through the compressor outlet 12. The superheated or vaporous refrigerant is guided to flow into the first water heating unit 462 of the water heater 46. A predetermined amount of heat is extracted to the water contained in the water heater 46 so as to produce hot water for the air conditioning and heat pump system. The refrigerant then leaves the water heater 46 and is guided to flow through the third connecting port 403 of the first connecting valve 41. In the heat pump mode, the first connecting valve 41 is configured such that the third connecting port 403 is connected to the fourth connecting port 404 while the first connecting port 401 is connected to the second connecting port 402 (normal mode). Thus, the refrigerant is guided to leave the first connecting valve 41 through the fourth connecting port 404, which is connected to the seventh connecting port 407 of the second connecting valve 42.

The second connecting valve 42 is configured such that the seventh connecting port 407 is connected to the sixth connecting port 406 while the fifth connecting port 405 is connected to the eighth connecting port 408 (switched mode). As a result, the refrigerant entering the seventh connecting port 407 is guided to pass through the sixth connecting port 406, which is connected to the first heat exchanging port 451 of the heat exchanger 45. The refrigerant then performs heat exchange in the heat exchanger 45 for extracting heat to the indoor space.

On the other hand, the fourth connecting valve 44 is configured such that the fourteenth connecting port 414 is connected to the fifteenth connecting port 415 while the thirteenth connecting port 413 is connected to the sixteenth connecting port 416 (switched mode). Thus, the refrigerant leaving the heat exchanger 45 is guided to flow through the fourteenth connecting port 414 and the fifteenth connecting valve 415. The refrigerant is then guided to pass through, sequentially, a unidirectional valve 49, a manual valve 491, a drying filter 47, another manual valve 491, an expansion valve 48, the thirteenth connecting port 413 of the fourth connecting valve 44, and then the sixteenth connecting port 416, which is connected to the second evaporator port 22 of the evaporator unit 2. The refrigerant enters the evaporator unit 2 and performs heat exchange for absorbing heat from ambient air.

The refrigerant then leaves the evaporator unit 2 through the first evaporator port 21 and is guided to pass through the tenth connecting port 410 of the third connecting valve 43. The third connecting valve 43 is configured such that the tenth connecting port 410 is connected to the eleventh connecting port 411 while the ninth connecting port 409 is connected to the twelfth connecting port 412 (switched mode). Thus, the refrigerant passes through the eleventh connecting port 411 and the eighth connecting port 408 of the second connecting valve 42. The second connecting valve 42 is configured such that the eighth connecting port 408 is connected to the fifth connecting port 405 while the seventh connecting port 407 is connected to the sixth connecting port 406. The refrigerant then pass through the fifth connecting port 405 and goes back to the compressor inlet 11 of the compressor unit 1. This completes one refrigerant cycle for a heat pump mode.

It is worth mentioning that when the air conditioning and heat pump system is in the heat pump mode, the evaporative cooling system 200 and the second water heating unit 463 are idle. Residual refrigerant trapped in the evaporative cooling system 200 should be guided to return to the main system (i.e. non-idle components) in order to prevent inadequate refrigerant circulating through the non-idle components of the air conditioning and heat pump system. According to the preferred embodiment of the present invention, residual refrigerant in the evaporative cooling system 200 will be guided to leave the evaporative cooling system 200 through the central fluid inlet 53 of the corresponding multiple-effect evaporative condenser 5 and is then guided to pass through one two-way valve 490 and merge with the refrigerant circulating through the non-idle components and going back to the compressor unit 1.

On the other hand, the residual refrigerant in the second water heating unit 463 will be guided to leave the corresponding heat exchanging pipes 4631, pass through a two-way valve 490, and merge with the refrigerant circulating through the non-idle components and going back to the compressor inlet 11 of the compressor unit 1.

According to the preferred embodiment of the present invention, the air conditioning and heat pump system may also operate in a water heater mode. In this mode, the air conditioning and heat pump system does not produce air conditioning or delivering warm air. Rather, the air conditioning and heat pump system produces hot water only. In this particular mode, refrigerant leaves the compressor unit 1 through the compressor outlet 12 and is guided to flow into the first water heating unit 462 of the water heater 46. The refrigerant then leaves the first water heating unit 462 and passes through the third connecting port 403 of the first connecting valve 41. The first connecting valve 41 is configured such that the third connecting port 403 is connected to the second connecting port 402 while the first connecting port 401 is connected to the fourth connecting port 404 (switched mode). The refrigerant then passes through the second connecting port 402 and enters the second water heating unit 463 of the water heater 46. The refrigerant in the water heater 46 is arranged to extract heat to the incoming water so as to heat up the water in the water heater 46.

The refrigerant then passes through a unidirectional valve 49, a manual valve 491, a drying filter 47, another manual valve 491, an expansion valve 48, and reaches the thirteenth connecting port 413 of the fourth connecting valve 44. The fourth connecting valve 44 is configured such that the thirteenth connecting port 413 is connected to the sixteenth connecting port 416 while the fourteenth connecting port 414 is connected to the fifteenth connecting port 415 (switched mode). The refrigerant then passes through the sixteenth connecting port 416 and enters the evaporator unit 2 through the second evaporator port 22. The refrigerant performs heat exchange with the ambient air and absorbs heat therefrom. The refrigerant then leaves the evaporator unit 2 through the first evaporator port 21 and reaches the tenth connecting port 410 of the third connecting valve 43. The third connecting valve 43 is configured such that the tenth connecting port 410 is connected to the eleventh connecting port 411 while the ninth connecting port 409 is connected to the twelfth connecting port 412 (switched mode). The refrigerant then passes through the eleventh connecting port 411 and reaches the eighth connecting port 408 of the second connecting valve 42. The second connecting valve 42 is configured such that the eighth connecting port 408 is connected to the fifth connecting port 405 while the seventh connecting port 407 is connected to the sixth connecting port 406 (switched mode). The refrigerant then passes through the fifth connecting port 405 and is finally guided to flow back to the compressor unit 1 through the compressor inlet 12.

It is worth mentioning that when the air conditioning and heat pump system is in the heat pump mode, the evaporative cooling system 200 and the heat exchanger 45 are idle. Residual refrigerant trapped in the idle components should be guided to return to the main system (i.e. non-idle components) in order to prevent inadequate refrigerant circulating through the non-idle components of the air conditioning and heat pump system. According to the preferred embodiment of the present invention, residual refrigerant in the evaporative cooling system 200 will be guided to leave the evaporative cooling system 200 through the central fluid inlet 53 of the corresponding multiple-effect evaporative condenser 5 and is then guided to pass through one two-way valve 490 and merge with the refrigerant circulating through the non-idle components and going back to the compressor unit 1.

On the other hand, the residual refrigerant in the heat exchanger 45 will be guided to leave the heat exchanger 45 through the first heat exchanging port 451 and pass through a two-way valve 490, and merge with the refrigerant circulating through the non-idle components and going back to the compressor inlet 11 of the compressor unit 1.

The air conditioning and heat pump system may also operate in a defrosting mode. In the preferred embodiment, refrigerant leaves the compressor unit 1 through the compressor outlet 11 and enters the first water heating unit 462 of the water heater 46. The refrigerant heats up the water contained in the water heater 46 and is guided to pass through the third connecting port 403 of the first connecting valve 41. The first connecting valve 41 is configured such that the third connecting port 403 is connected to the fourth connecting port 404 while the first connecting port 401 is connected to the second connecting port 402 (normal mode). The refrigerant is then guided to pass through the seventh connecting port 407 of the second connecting valve 42. The second connecting valve 42 is configured such that the seventh connecting port 407 is connected to the eighth connecting port 408 while the fifth connecting port 405 is connected to the sixth connecting port 406 (normal mode). The refrigerant the passes through the eighth connecting port 408 and reaches the eleventh connecting port 411 of the third connecting valve. The third connecting valve 43 is configured such that the eleventh connecting port 411 is connected to the tenth connecting port 410 while the twelfth connecting port 412 is connected to the ninth connecting port 409 (switched mode). The refrigerant passes through the tenth connecting port 410 and enters the evaporator unit 2 through the first evaporator port 21 and the auxiliary frost removal arrangement 28 which is connected to the evaporator unit 2 in parallel with each other. The refrigerant extracts heat to the evaporator unit 2 for defrosting and leaves the evaporator unit 2 and the frost removal arrangement 28. The refrigerant then passes through the sixteenth connecting port 416 of the fourth connecting valve 44. The fourth connecting valve 44 is configured such that the sixteenth connecting port 416 the fifteenth connecting port 415 while the thirteenth connecting port 413 is connected to the fourteenth connecting port 414 (normal mode). The refrigerant passes through the fifteenth connecting port 415, a unidirectional valve 49, a manual valve 491, a drying filter 47, another manual valve 491, an expansion valve 48 and reaches the thirteenth connecting port 413 of the fourth connecting valve 44. The refrigerant continues to pass through the fourteenth connecting port 414 and enters the heat exchanger 45 through the second heat exchanging port 452.

The refrigerant then performs heat exchange in the heat exchanger 45 and absorbs heat from the indoor space. After that, the refrigerant leaves the heat exchanger 45 through the first heat exchanging port 451 and passes through the sixth connecting port 406, the seventh connecting port 407 and finally goes back to the compressor unit 1 through the compressor inlet 11.

The auxiliary frost removal arrangement 28 is connected to the evaporator unit 2 in parallel so that some of the refrigerant flowing into the evaporator unit 2 will be divided to flow into the auxiliary frost removal arrangement 28 through a flow regulator 492. Moreover, the refrigerant flowing out of the frost removal arrangement 28 will pass through a unidirectional valve 49 and eventually merge with the refrigerant flowing out of the evaporator unit 2 and enter the main system as described above.

When the auxiliary frost removal arrangement 28 is idle, the refrigerant trapped in the heat exchanging pipes 282 will be guided to flow out of them and enter the evaporator unit 2 through the second evaporator port 22. The refrigerant is then guided to flow out of the evaporator unit 2 through the first evaporator port 21 and passes through one two-way valve 490 and finally goes back to the compressor unit 1 through the compressor inlet 11.

Figure 24:
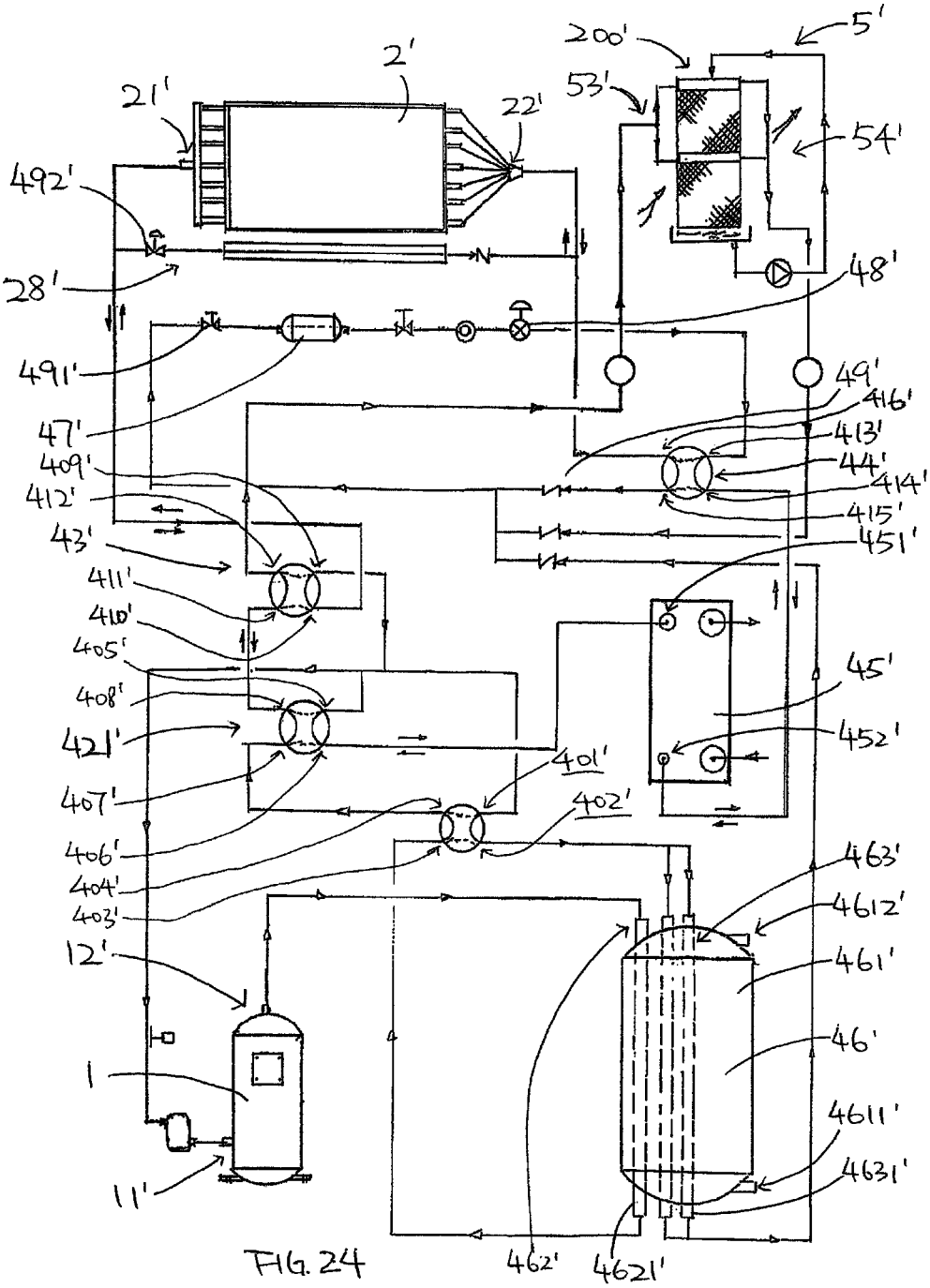
FIG. 24 is a system diagram of various components of the air conditioning and heat pump system according to a first alternative mode of the preferred embodiment of the present invention.

Referring to FIG. 24 to FIG. 26 of the drawings, a first alternative mode of the air conditioning and heat pump system according to the preferred embodiment of the present invention is illustrated. The first alternative mode is similar to the preferred embodiment, except the way in which the various components are connected and the way in which the refrigerant is guided to circulate. According to the first alternative mode, the air conditioning and heat pump system comprises two compressor units 1', two evaporator units 2', two evaporative cooling systems 200', the water heater 46', two heat exchangers 45', a plurality of drying filters 47', a plurality of expansion valves 48', a plurality of unidirectional valves 49', a plurality of manual valves 491', and a plurality of connecting valves. As in the preferred embodiment, the air conditioning and heat pump system comprises two cooling and heating loops in which each loop comprises one compressor unit 1', one evaporator unit 2', one evaporative cooling system 200', one heat exchanger 45', a predetermined number of dryer filters 47', a predetermined number of expansion valves 48', a predetermined number of unidirectional valves 49', a predetermined number of two-way valves 490', a predetermined number of manual valves 491', and first through fourth connecting valves 41', 42', 43', 44'. The two cooling and heating loops share one common water heater 46'.

The air conditioning and heat pump system of the present invention may selectively operate between an air conditioning mode (for delivering cooled air and hot water in an indoor space) and a heat pump mode (for delivering warm air and hot water in the indoor space). Apart from these two modes, the present invention is capable of independently producing hot water even when the air conditioning mode or the heat pump mode is not operating (water heater mode). In other words, the user of the present invention does not need to additionally install a water heater system. The user needs to install only one single system to selectively enjoy cooled air and hot water, or heated air and hot water.

As shown in FIG. 24 of the drawings, for each of the cooling and heating loops, the compressor unit 1' has a compressor outlet 12' connected to the water heater 46', and a compressor inlet 11'. The compressor inlet 11' is connected to the first connecting port 401' of the first connecting valve 41', a predetermined number of unidirectional valves 49', and a predetermined number of two-way valves 490'. The exact connection between these components is shown in FIG. 24.

As shown in FIG. 25 and FIG. 26 of the drawings, each of the first through fourth connecting valve 41', 42', 43', 44' may operate between a normal mode and a switched mode. For the first connecting valve 41', it has first through fourth connecting port 401', 402', 403', 404'. When the first connecting valve 41' is in the normal mode, the first connecting port 401' is connected to the second connecting port 402' while the third connecting port 403' is connected to the fourth connecting port 404'. When the first connecting valve 41' is in the switched mode, the first connecting port 401' is connected to the fourth connecting port 404' while the second connecting port 402' is connected to the third connecting port 403'.

For the second connecting valve 42', it has fifth through eighth connecting port 405', 406', 407', 408'. When the second connecting valve 42' is in the normal mode, the fifth connecting port 405' is selectively connected to the sixth connecting port 406' while the seventh connecting port 407' is connected to the eighth connecting port 408. When the second connecting valve 42' is in the switched mode, the fifth connecting port 405' is connected to the eighth connecting port 408' while the sixth connecting port 406' is connected to the seventh connecting port 407'.

For the third connecting valve 43', it has ninth through twelfth connecting port 409', 410', 411', 412'. When the third connecting valve 43' is in the normal mode, the ninth connecting port 409' is selectively connected to the tenth connecting port 410' while the eleventh connecting port 411' is connected to the twelfth connecting port 412'. When the third connecting valve 43' is in the switched mode, the ninth connecting port 409' is connected to the twelfth connecting port 412' while the tenth connecting port 410' is connected to the eleventh connecting port 411'.

For the fourth connecting valve 44', it has thirteenth through sixteen connecting port 413', 414', 415', 416'. When the fourth connecting valve 44' is in the normal mode, the thirteenth connecting port 413' is selectively connected to the fourteenth connecting port 414' while the fifteenth connecting port 415' is connected to the sixteenth connecting port 416'. When the fourth connecting valve 44' is in the switched mode, the thirteenth connecting port 413' is connected to the sixteenth connecting port 416' while the fourteenth connecting port 414' is connected to the fifteenth connecting port 415'.

The heat exchanger 45' has a first exchanging port 451' and a second exchanging port 452' for allowing passage of the refrigerant and for communicating the heat exchanger 45' with other components of the air conditioning and heat pump system. The first exchanging port 451' is connected to the sixth connecting port 406' of the second connecting valve 42'. The second exchanging port 452' is connected to the fourteenth connecting port 414' of the fourth connecting valve 44'.

On the other hand, the evaporator unit 2' has a first evaporator port 21' and a second evaporator port 22' for allowing passage of refrigerant. The first evaporator port 21' is connected to the tenth connecting port 410' of the third connecting valve 43', and the auxiliary frost removal arrangement 28'. The second evaporator port 22' is connected to auxiliary frost removal arrangement 28', and the sixteenth connecting port 416' of the fourth connecting valve 44'.

The evaporative cooling system 200' has a central fluid inlet 53' connected to all of the fluid inlets 6411 (7411) of all of the cooling units 6, 7, 8, 9, 10, and a central fluid outlet 54 connecting all of the fluid outlets 6412 (7412) of all of the cooling units 6, 7, 8, 9, 10 of the evaporative cooling system 200'. The central fluid inlet 53' is connected to the twelfth connecting port 412' of the third connecting valve 43'. The central fluid outlet 54' is connected to the thirteenth connecting port 413' of the fourth connecting valve 44', and the fifteenth connecting port 415' of the fourth connecting valve 44' through a unidirectional valve 49'.

The water heater 46' comprises a heater housing 461' having a water inlet 4611' provided at a lower portion thereof, and a water outlet 4612' provided at an upper portion of the heater housing 461', a first water heating unit 462', and a second water heating unit 463'. As mentioned above, a single water heater 46' is utilized for producing hot water for both cooling and heating loops.

The first water heating unit 462' comprises a plurality of heat exchanging pipes 4621' detachably attached in the heater housing 461', and is arranged to contact with the water coming from the water inlet 4611'. Refrigerant is guided to flow through the heat exchanging pipes 4621' for performing heat exchange with the water so that heat in the refrigerant is extracted to the water for increasing the temperature of the water. The hot water is then guided to flow out of the water heater 46' through the water outlet 4612'.

Similarly, the second water heating unit 463' comprises a plurality of heat exchanging pipes 4631' detachably attached in the heater housing 461', and is arranged to contact with the water coming from the water inlet 4611'. Refrigerant is guided to flow through the heat exchanging pipes 4631' for performing heat exchange with the water so that heat in the refrigerant is extracted to the water for increasing the temperature of the water. The hot water is then guided to flow out of the water heater 46' through the water outlet 4612'. The first water heating unit 462' is connected to the compressor outlet 12' of the compressor unit 1', while the second water heating unit 463' is connected to the second connecting port 402' of the first connecting valve 41'.

A predetermined amount of refrigerant is guided to flow through the above mentioned components for producing one of cooled air and hot water, warm air and hot water and hot water alone. When the air conditioning and heat pump system operates in air conditioning mode, superheated or vaporous refrigerant first leaves the compressor unit 1' through the compressor outlet 12'. The superheated or vaporous refrigerant is guided to flow into the first water heating unit 462' of the water heater 46'. A predetermined amount of heat is extracted to the water contained in the water heater 46' so as to produce hot water for the air conditioning and heat pump system. The refrigerant then leaves the water heater 46' and is guided to flow through the third connecting port 403' of the first connecting valve 41'. In the air conditioning mode, the first connecting valve 41' is in the normal mode. Thus, the refrigerant is guided to leave the first connecting valve 41' through the fourth connecting port 404', which is connected to the seventh connecting port 407' of the second connecting valve 42', which is also in its normal mode, as indicated in FIG. 26 of the drawings. As a result, the refrigerant entering the seventh connecting port 407' is guided to pass through the eighth connecting port 408', which is connected to the eleventh connecting port 411' of the third fourth-way valve 43'.

The third connecting valve 43' is configured in the normal mode such that the refrigerant entering the eleventh connecting port 411' is guided to pass through the twelfth connecting port 412', which is connected to the central fluid inlet 53' of the evaporative cooling system 200'. The refrigerant is then cooled down and condensed by the corresponding multiple effect evaporative condenser 5' (in the manner described above) and leaves the multiple effect evaporative condenser 5' through the central fluid outlet 54'. The refrigerant is then guided to pass through, sequentially, a unidirectional valve 49', a first manual valve 491', a dryer filter 47', a second manual valve 491', an expansion valve 48', and finally reaches the thirteenth connecting port 413' of the fourth connecting valve 44'.

As indicated in FIG. 26, the fourth connecting valve 44' is configured in normal mode such that the refrigerant entering the thirteenth connecting port 413' is guided to pass through the fourteenth connecting port 414', which is connected to the second exchanging port 452' of the heat exchanger 45'. The refrigerant entering the heat exchanger 45' is arranged to absorb heat from the indoor space. The superheated or vaporous refrigerant is then arranged to leave the heat exchanger 45' through the first exchanging port 451', which is connected to the sixth connecting port 406' of the second connecting valve 42'. The refrigerant then passes through the fifth connecting port 405' which is connected to the compressor inlet 11' of the compressor unit 10'. The refrigerant then goes back to the compressor unit 10' and completes one refrigerant cycle for producing cooled air in the indoor space.

Again, when the air conditioning and heat pump system is in the air conditioning mode, the evaporator unit 2' and the second water heating unit 463' are idle. Residual refrigerant in the evaporator unit 2' will be guided to leave the evaporator unit 2' through a first evaporator port 21' and pass through the tenth connecting port 410' and the ninth connecting port 409' of the second connecting valve 42' and merge with the refrigerant circulating through the non-idle components and going back to the compressor inlet 11' of the compressor unit 1'.

On the other hand, the residual refrigerant in the second water heating unit 463' will be guided to leave the corresponding heat exchanging pipes 4631', pass through the second connecting port 402', the first connecting port 401', and merge with the refrigerant circulating through the non-idle components and going back to the compressor inlet 11' of the compressor unit 1'.

When the air conditioning and heat pump system operates in the heat pump mode, superheated or vaporous refrigerant first leaves the compressor unit 1' through the compressor outlet 12'. The superheated or vaporous refrigerant is guided to flow into the first water heating unit 462' of the water heater 46'. A predetermined amount of heat is extracted to the water contained in the water heater 46' so as to produce hot water for the air conditioning and heat pump system. The refrigerant then leaves the water heater 46' and is guided to flow through the third connecting port 403' of the first connecting valve 41'. In the heat pump mode, the first connecting valve 41' is configured in the normal mode such that the refrigerant can pass through the fourth connecting port 404', which is connected to the seventh connecting port 407' of the second connecting valve 42'.

The second connecting valve 42' is configured in a switched mode such that the refrigerant passes through the seventh connecting port 407' and the sixth connecting port 406', which is connected to the first heat exchanging port 451' of the heat exchanger 45'. The refrigerant then performs heat exchange in the heat exchanger 45' for delivering heat to the indoor space.

On the other hand, the fourth connecting valve 44' is configured to be in a switched mode. Thus, the refrigerant leaving the heat exchanger 45' through the second heat exchanging port 452' is guided to flow through the fourteenth connecting port 414' and the fifteenth connecting valve 415'. The refrigerant is then guided to pass through, sequentially, a unidirectional valve 49', a manual valve 491', a drying filter 47', another manual valve 491', an expansion valve 48', the thirteenth connecting port 413' of the fourth connecting valve 44', and then the sixteenth connecting port 416', which is connected to the second evaporator port 22' of the evaporator unit 2'. The refrigerant enters the evaporator unit 2' and performs heat exchange for absorbing heat from ambient air.

The refrigerant then leaves the evaporator unit 2' through the first evaporator port 21' and is guided to pass through the tenth connecting port 410' of the third connecting valve 43', which is also configured in switched mode. Thus, the refrigerant passes through the tenth connecting port 410' and the eleventh connecting port 411', which is connected to the eighth connecting port 408' of the second connecting valve 42'. The second connecting valve 42' is configured in a switched mode. The refrigerant then passes through the eighth connecting port 408' and the fifth connecting port 405' of the second connecting valve 42'. Finally, the refrigerant is guided to flow back to the compressor unit 1' through the compressor inlet 11'.

It is worth mentioning that when the air conditioning and heat pump system is in the heat pump mode, the evaporative cooling system 200' and the second water heating unit 463' are idle. Residual refrigerant in the evaporative cooling system 200' will be guided to leave the evaporative cooling system 200' through the central fluid inlet 53' of the corresponding multiple-effect evaporative condenser 5' and is then guided to pass through the twelfth connecting port 412' and the ninth connecting port 409' of the third connecting valve 43', and eventually merge with the refrigerant circulating through the non-idle components and going back to the compressor unit 1.

On the other hand, the residual refrigerant in the second water heating unit 463' will be guided to leave the corresponding heat exchanging pipes 4631', pass through a the second connecting port 402' and the first connecting port 401' of the first connecting valve 41', and merge with the refrigerant circulating through the non-idle components and going back to the compressor inlet 11' of the compressor unit 1'.

According to the preferred embodiment of the present invention, the air conditioning and heat pump system may also operate in a water heater mode. In this mode, the air conditioning and heat pump system produces hot water only. Refrigerant leaves the compressor unit 1' through the compressor outlet 12' and is guided to flow into the first water heating unit 462' of the water heater 46'. The refrigerant then leaves the first water heating unit 462' and passes through the third connecting port 403' of the first connecting valve 41'. The first connecting valve 41 is configured in a switched mode such that the refrigerant passes through the second connecting port 402' and enters the second water heating unit 463' of the water heater 46'. The refrigerant in the water heater 46' is arranged to extract heat to the incoming water so as to heat up the water in the water heater 46'.

The refrigerant then passes through a unidirectional valve 49', a manual valve 491', a drying filter 47', another manual valve 491', an expansion valve 48', and reaches the thirteenth connecting port 413' of the fourth connecting valve 44'. The fourth connecting valve 44' is configured in a switched mode such that the thirteenth connecting port 413' is connected to the sixteenth connecting port 416'. The refrigerant then passes through the sixteenth connecting port 416' and enters the evaporator unit 2' through the second evaporator port 22'. The refrigerant performs heat exchange with the ambient air and absorbs heat therefrom. The refrigerant then leaves the evaporator unit 2' through the first evaporator port 21' and reaches the tenth connecting port 410' of the third connecting valve 43'. The third connecting valve 43' is configured in normal mode such that the tenth connecting port 410' is connected to the ninth connecting port 409'. The refrigerant is then guided to flow back to the compressor unit 1' through the compressor inlet 12' and this completes one refrigerant cycle.

It is worth mentioning that when the air conditioning and heat pump system is in the water heater mode, the evaporative cooling system 200' and the heat exchanger 45' are idle. Residual refrigerant in the evaporative cooling system 200' will be guided to leave the evaporative cooling system 200' through the central fluid inlet 53' of the corresponding multiple-effect evaporative condenser 5' and is then guided to pass through the twelfth connecting port 412', the eleventh connecting port 411' of the third connecting valve 43' which is configured in normal mode. The refrigerant then passes through the eighth connecting port 408' and the seventh connecting port 407' of the second connecting valve 42' which is configured in the normal mode. The refrigerant is then guided to pass through the fourth connecting port 404' and the first connecting port 401' of the first connecting valve 41' which is configured in the switched mode. Finally, the refrigerant merges with the refrigerant circulating through the non-idle components and going back to the compressor unit 1'.

On the other hand, the residual refrigerant in the heat exchanger 45' will be guided to leave the heat exchanger 45' through the first heat exchanging port 451' and pass through the sixth connecting port 406', the fifth connecting port 405' of the second connecting valve 42', and merge with the refrigerant circulating through the non-idle components and going back to the compressor inlet 11' of the compressor unit 1'.

The air conditioning and heat pump system may also operate in a defrosting mode. In the preferred embodiment, refrigerant leaves the compressor unit 1' through the compressor outlet 11' and enters the first water heating unit 462' of the water heater 46'. The refrigerant heats up the water contained in the water heater 46' and is guided to pass through the third connecting port 403' of the first connecting valve 41' which is configured in normal mode. The refrigerant is then guided to pass through the fourth connecting port 404' and the seventh connecting port 407' of the second connecting valve 42'. The second connecting valve 42' is configured in normal mode such that the seventh connecting port 407' is connected to the eighth connecting port 408'. The refrigerant the passes through the eighth connecting port 408' and reaches the eleventh connecting port 411' of the third connecting valve 43'. The third connecting valve 43' is configured in switched mode such that the eleventh connecting port 411' is connected to the tenth connecting port 410'. The refrigerant passes through the tenth connecting port 410' and enters the evaporator unit 2' through the first evaporator port 21'. A predetermined amount of refrigerant may also enter the frost removal arrangement 28'. The refrigerant release to the evaporator unit 2' for removing frost from the evaporator unit 2'. The refrigerant then leaves the evaporator unit 2' through the second evaporator port 22'. The refrigerant then passes through the sixteenth connecting port 416' of the fourth connecting valve 44'. The fourth connecting valve 44' is configured in normal mode such that the sixteenth connecting port 416' is connected to the fifteenth connecting port 415'. The refrigerant passes through the fifteenth connecting port 415', a unidirectional valve 49', a manual valve 491', a drying filter 47', another manual valve 491', an expansion valve 48' and reaches the thirteenth connecting port 413' of the fourth connecting valve 44'. The refrigerant continues to pass through the fourteenth connecting port 414' and enters the heat exchanger 45' through the second heat exchanging port 452'.

The refrigerant then performs heat exchange in the heat exchanger 45' and absorb heat from the indoor space. After that, the refrigerant leaves the heat exchanger 45' through the first heat exchanging port 451' and passes through the sixth connecting port 406', the fifth connecting port 405' and finally goes back to the compressor unit 1' through the compressor inlet 11'.

When the air conditioning and heat pump system is in the defrosting mode, the evaporative cooling system 200' and the second water heating unit 463' of the water heater 46' are idle. Residual refrigerant in the evaporative cooling system 200' will be guided to leave the evaporative cooling system 200' through the central fluid inlet 53' of the corresponding multiple-effect evaporative condenser 5' and is then guided to pass through the twelfth connecting port 412', the ninth connecting port 409' of the third connecting valve 43', and finally merge with the refrigerant circulating through the non-idle components and going back to the compressor unit 1'.

On the other hand, the residual refrigerant in the second water heating unit 463' will be guided to leave the corresponding heat exchanging pipes 4631', pass through a the second connecting port 402' and the first connecting port 401' of the first connecting valve 41', and merge with the refrigerant circulating through the non-idle components and going back to the compressor inlet 11' of the compressor unit 1'.

The auxiliary frost removal arrangement 28' is connected to the evaporator unit 2' in parallel so that some of the refrigerant flowing into the evaporator unit 2' will be divided to flow into the auxiliary frost removal arrangement 28' through a flow regulator 492'. Moreover, the refrigerant flowing out of the frost removal arrangement 28' will pass through a unidirectional valve 49' and eventually merge with the refrigerant flowing out of the evaporator unit 2' and enter the main system as described above.

When the auxiliary frost removal arrangement 28' is idle, the refrigerant trapped in the heat exchanging pipes 282' will be guided to flow out of them and enter the evaporator unit 2' through the second evaporator port 22'. The refrigerant is then guided to flow out of the evaporator unit 2' through the first evaporator port 21' and passes through the tenth connecting port 410', the eleventh connecting port 411' of the third connecting valve 43', the eighth connecting port 408', the seventh connecting port 407', two-way valve 490 and finally goes back to the compressor unit 1 through the compressor inlet 11.

Figure 27:
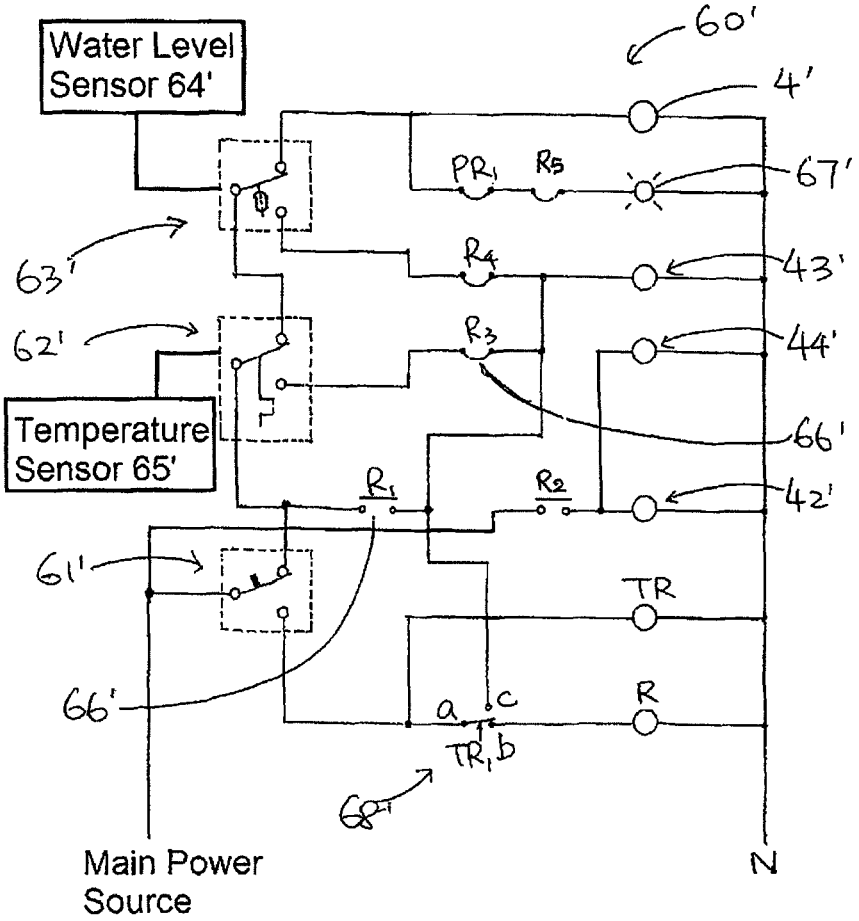
FIG. 27 is a schematic diagram of a cooler switching circuitry of the air conditioning and heat pump system according to the first alternative mode of the preferred embodiment of the present invention.

Referring to FIG. 27 of the drawings, the air conditioning and heat pump system according the first alternative mode further comprises a cooler switching circuitry 50' for selectively switching the air conditioning and heat pump system from operating in a water-cooled mode in which the refrigerant is primarily cooled by the evaporative cooling system 200', and an air-cooled mode in which the refrigerant is primarily cooled by the evaporator unit 2'.

The cooler switching arrangement 60' comprises a selection switch 61', a temperature switch 62', and a water level switch 63', wherein each of the selection switch 61', the temperature switch 62', and the water level switch 63' is arranged to be switched between two positions so as to selectively conduct electricity between a main power source and the components connecting to the selection switch 61', the temperature switch 62', and the water level switch 63'.

The cooler switching arrangement 60' further comprises a water level sensor 64' provided in each of the multiple-effect evaporative condensers 5' and is electrically connected to the temperature switch 62', a temperature sensor 65' electrically connected to the sensor switch 63', and a plurality of relays 66' electrically connected to at least one of the selection switch 61', the temperature switch 62', and the water level switch 63' for controlling the status of the second connecting valve 42', the third connecting valve 43', and the fourth connecting valve 44'.

With the operation of the cooler switching arrangement 60', and when the air conditioning and heat pump system of the present invention is operating in the air conditioning mode, the refrigerant may be switched between the air-cooled mode and water-cooled mode by altering the flowing route of the refrigerant. Specifically, when the air conditioning mode is being operated and the refrigerant is water-cooled, the selection switch 61', the temperature switch 62', and the water level switch 63' are switched to conduct electricity between the main power source and the pumping device 4' of the relevant multiple-effect evaporative condenser 5'. The air conditioning and heat pump system may work in the manner described above.

When the water level in the evaporative cooling unit 200' is too low as sensed by the water level sensor 64' (i.e. below a predetermined threshold) the air conditioning and heat pump system will be switched so that the refrigerant is to be air-cooled. In this scenario, the water level switch 63' is switched so as to switch the corresponding relay ($R_4$) 66' connecting the water level switch 63' and the third connecting valve 43'. As a result, the third connecting valve 43' will be operating under switched mode as shown in FIG. 25 and FIG. 26 of the drawings. The flowing route of the refrigerant is as follows: the refrigerant leaves the compressor unit 1' through the compressor outlet 12' and passes through the first water heating unit 462' of the water heater 46', the third connecting port 403', the fourth connecting port 404' of the first connecting valve 41'. The refrigerant then passes through the seventh connecting port 407', the eighth connecting port 408' of the second connecting valve 42'. The refrigerant then passes through the eleventh connecting port 411' and the tenth connecting port 410' of the third connecting valve 43' (because it is operated in switched mode). The refrigerant is then guided to flow into the evaporator unit 2' through the first evaporator port 21'. The refrigerant is arranged to extract heat to the ambient air and is therefore cooled by air. The refrigerant is then guided to leave the evaporator unit 2' through the second evaporator unit 22', the sixteenth connecting port 416', the fifteenth connecting port 415' of the fourth connecting valve 44', and sequentially, a unidirectional valve 49', a first manual valve 491', a dryer filter 47', a second manual valve 491', an expansion valve 48', and finally reaches the thirteenth connecting port 413' of the fourth connecting valve 44'.

As indicated in FIG. 26, the refrigerant entering the thirteenth connecting port 413' is guided to pass through the fourteenth connecting port 414', which is connected to the second exchanging port 452' of the heat exchanger 45'. The refrigerant entering the heat exchanger 45' is arranged to absorb heat from the indoor space. The superheated or vaporous refrigerant is then arranged to leave the heat exchanger 45' through the first exchanging port 451', which is connected to the sixth connecting port 406' of the second connecting valve 42'. The refrigerant then passes through the fifth connecting port 405' which is connected to the compressor inlet 11' of the compressor unit 10'. The refrigerant then goes back to the compressor unit 10' and completes one refrigerant cycle.

When the water level in the evaporative cooling unit 200' resumes normal, the water level switch 63' is switched back to its original state so that the air conditioning and heat pump system is operated under the air conditioning mode in which the refrigerant is cooled by the cooling water in the corresponding multiple-effect evaporative condenser 5' (in the manner described above). In this case, the third connecting valve 43' is configured in the normal mode again.

Furthermore, when a temperature of the ambient air falls below a predetermined threshold, the temperature switch 62 'is switched such that the third connecting valve 43' is switched to the switched mode. The flowing route of the refrigerant is then altered in the manner described above when the water level of the cooling water falls below a predetermined threshold. The refrigerant is then cooled by the evaporator unit 2', instead of the evaporative cooling system 200'. When the temperature of the ambient air is above the predetermined threshold, the water level switch 63' is switched back to its original state so that the air conditioning and heat pump system is operated under the air conditioning mode in which the refrigerant is cooled by the cooling water in the corresponding multiple-effect evaporative condenser 5' (in the manner described above). Note that the selection switch 61' may be used by the user of the present invention to select between the air conditioning mode and the heat pump mode. As shown in FIG. 27 of the drawings, an alarm device 67' may be installed on the corresponding multiple-effect evaporative condenser 5' so that when the water level of the cooling water is too low, the alarm device 67' may be triggered to alert users or technicians of the present invention. Moreover, a defrost switch 68' may also be provided for allowing the user to switch between the heat pump mode and the defrosting mode.

Referring to FIG. 28 to FIG. 31 of the drawings, a second alternative mode of the air conditioning and heat pump system according to the preferred embodiment of the present invention is illustrated. The second alternative mode is similar to the preferred embodiment as mentioned above, except that in the second alternative mode, two of the connecting valves are replaced by one multi-communicative valve 29". As a result, the multi-communicative valve 29", the first connecting valve 41" and the second connecting valve 42" constitute a multi-communicative valve unit in the air conditioning and heat pump system of the present invention. The first connecting valve 41" and the second connecting valve 42" are structurally identical to the first connecting valve 41 (41') and the second connecting valve 42 (42') described in the preferred embodiment and the first alternative mode above.

The multi-communicative valve unit and the various components (mentioned above) of the air conditioning and heat pump system serve to establish the air conditioning mode, the heat pump mode, the water heater mode, and the defrosting mode of the present invention.

Figure 29:
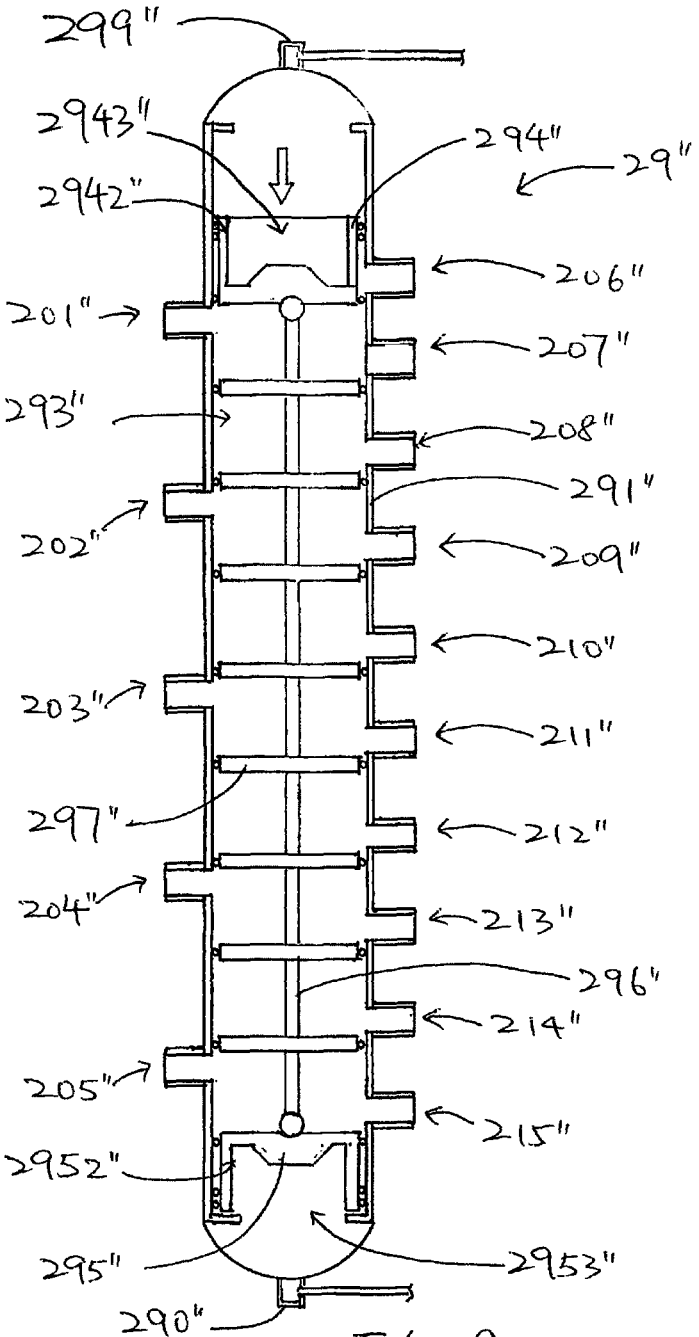
FIG. 29 is a sectional side view of a multi-communicative valve according to a second alternative mode of the preferred embodiment of the present invention.

In this second alternative mode, the multi-communicative valve unit comprises a first and a second connecting valve 41", 42", and a multi-communicative valve 29' connected to the first connecting valve 41" and the second connecting valve 42". As shown in FIG. 29 of the drawings, the multi-communicative valve 29" comprises an elongated main body 291" having a plurality of communicative ports formed thereon, wherein each of the communicative ports are connected with a corresponding component of the air conditioning and heat pump system, preferably through a plurality of connecting pipe. In the second alternative mode of the present invention, the elongated main body 291" has first through fifteenth communicative port 201", 202", 203", 204", 205", 206", 207", 208", 209", 210", 211", 212", 213", 214", 215".

The elongated main body 291" defines a receiving cavity 293" formed therein, wherein the first through fifteenth communicative port 201", 202", 203", 204", 205", 206", 207", 208", 209", 210", 211", 212", 213", 214", 215" communicate the receiving cavity 293" with an exterior of the elongated main body 291". In this particular alternative mode of the present invention, the first through fifth communicative port 201", 202", 203", 204", 205" are spacedly formed at one side of the elongated main body 291", while the sixth through fifteenth communicative port 206", 207", 208", 209", 210", 211", 212", 213", 214", 215" are spacedly formed at an opposed side of the elongated main body 291".

The multi-communicative valve 29" further comprises a first piston member 294", a second piston member 295" movably provided in the receiving cavity 293" of the elongated main body 291", and a linking member 296" extended between the first piston member 294" and the second piston member 295" in such a manner that when one of the first piston member 294" and the second piston member 295" is driven to move, the other piston member 294" (295") is also driven to move through the linking member 296". In other words, when the first piston member 294" is driven to move, the second piston member 295" is also driven to move through the linking member 296", or when the second piston member 295" is driven to move, the first piston member 294" is also driven to move through the linking member 296".

Moreover, the multi-communicative valve 29" further comprises a plurality of partitioning members 297" spacedly and movably mounted in the receiving cavity 293" to define a plurality of passage compartments 298", wherein the partitioning members 297" are connected to the linking member 296" so as to be selectively moved to block fluid passage against at least one of the first through fifteenth communicative port 201", 202", 203", 204", 205", 206", 207", 208", 209", 210", 211", 212", 213", 214", 215" so as to enable passage of refrigerant in the air conditioning and heat pump system for allowing it to operate one of the air conditioning mode, the heat pump mode, the water heater mode and the defrosting mode.

The first piston member 294" has a first transverse portion 2941" connected to the corresponding end portion of the linking member 296", and a first longitudinal portion 2942" integrally and outwardly extended from the first transverse portion 2941" to define a first piston cavity 2943" within the first transverse portion 2941" and the first longitudinal portion 2942". Similarly, the second piston member 295" has a second transverse portion 2951" connected to the corresponding end portion of the linking member 296", and a second longitudinal portion 2952" integrally and outwardly extended from the second transverse portion 2951" to define a second piston cavity 2953" within the second transverse portion 2951" and the second longitudinal portion 2952".

The multi-communicative valve 29" further has a first pressure port 299" and a second pressure port 290" formed at two end portions of the elongated main body 291" respectively, wherein the first pressure port 299" and the second pressure port 290" are communicated with the first and the second piston cavity 2943", 2953" respectively so that when a predetermined pressure differential is developed between the first pressure port 299" and the second pressure port 290", a corresponding pressure differential is also developed between the first piston cavity 2943" and the second piston cavity 2953", and this pressure differential is arranged to drive the first piston member 294" and the second piston member 295" to move longitudinally along the elongated main body 291". The pressure differential between the first pressure port 299" and the second pressure port 290" may be accomplished by connecting the first pressure port 299" and the second pressure port 290" to a pressure pump device or a compressor.

Figure 28:
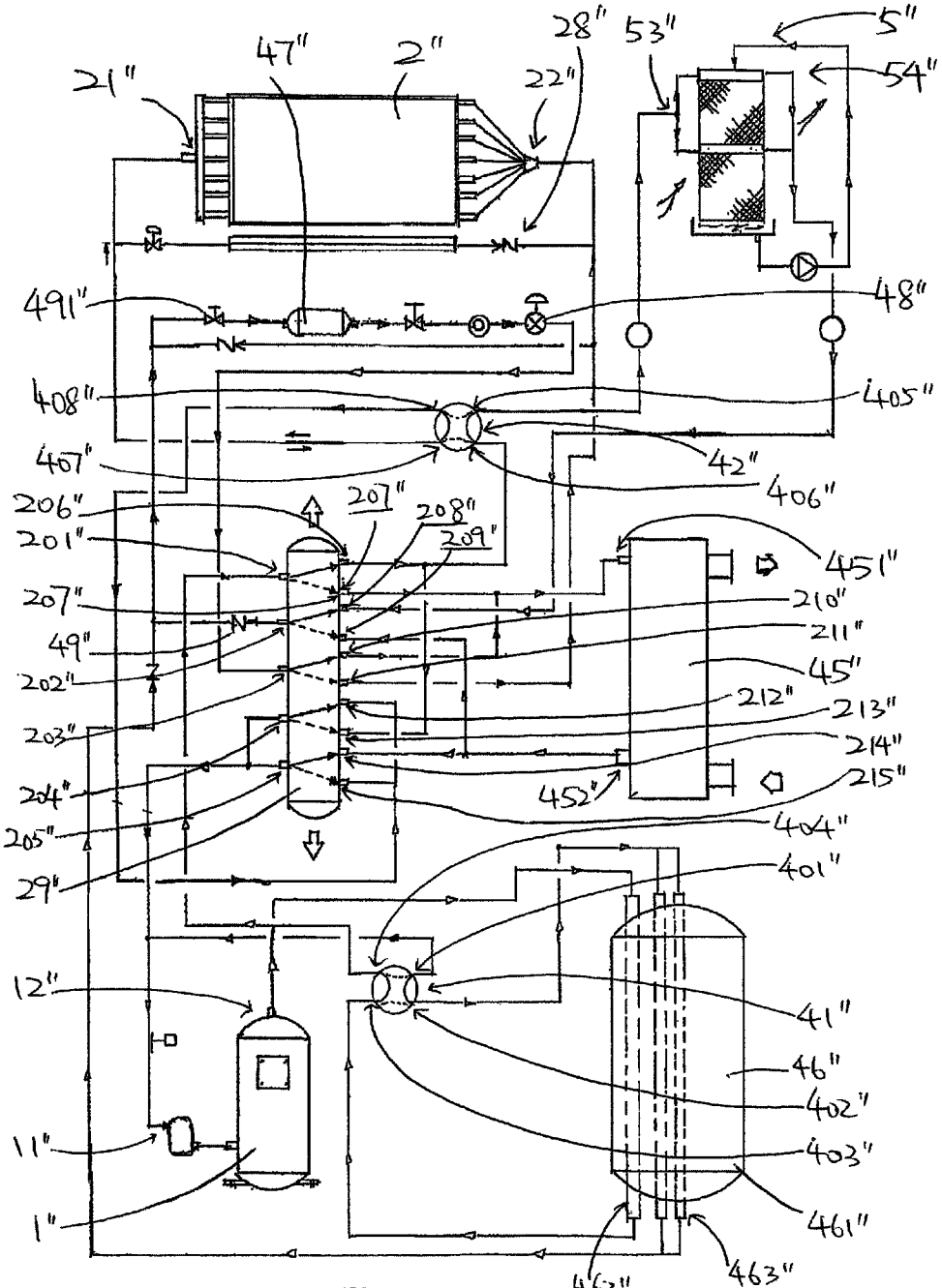
FIG. 28 is a system diagram of various components of the air conditioning and heat pump system according to a second alternative mode of the preferred embodiment of the present invention.

The multi-communicative valve 29" may be switched between a normal mode and a switched mode, wherein in the normal mode, the piston members 294", 295" are driven to move such that the first communicative port 201" is communicated with the sixth communicative port 206", the second communicative port 202" is communicated with the eighth communicative port 208", the third communicative port 203" is communicated with the tenth communicative port 210", the fourth communicative port 204" is communicated with the twelfth communicative port 212", the fifth communicative port 205" is communicated with the fourteenth communicative port 214", as shown in FIG. 28 of the drawings.

When the multi-communicative valve 29" is in the switched mode, the piston members 294", 295" are driven to move such that the first communicative port 201" is communicated with the seventh communicative port 207", the second communicative port 202" is communicated with the ninth communicative port 209", the third communicative port 203" is communicated with the eleventh communicative port 211", the fourth communicative port 204" is communicated with the thirteenth communicative port 213", the fifth communicative port 205" is communicated with the fifteenth communicative port 215".

Furthermore, each of the first connecting valve 41" and the second connecting valve 42" may be selective switched between a normal mode and a switched mode. In the normal mode, the first connecting valve 41" is switched such that the first connecting port 401" is connected to the second connecting port 402" while the third connecting port 403" is connected to the fourth connecting port 404". Moreover, the second connecting valve 42" is switched such that the fifth connecting port 405" is connected to the sixth connecting port 406" while the seventh connecting port 407" is connected to the eighth connecting port 408".

In the switched mode, the first connecting valve 41" is switched such that the first connecting port 401" is connected to the fourth connecting port 404" while the second connecting port 402" is connected to the third connecting port 403". Moreover, the second connecting valve 42" is switched such that the fifth connecting port 405" is connected to the eighth connecting port 408" while the sixth connecting port 406" is connected to the seventh connecting port 407". These connections are illustrated in FIG. 28 to FIG. 31 of the drawings.

Referring to FIG. 28 of the drawings, the compressor unit 1" is connected to the first water heating unit 452" of the water heater 45", which is also connected to the third connecting port 403" of the first connecting valve 41". On the other hand, the second water heating unit 453" is connected to the second connecting port 402" of the first connecting valve 41", the second communicative port 202" of the multi-communicative valve 29", the third communicative port 203", the evaporator unit 2", and the tenth communicative port 210".

The heat exchanger 45" has a first heat exchanging port 451" connected to the seventh communicative port 207" of the multi-communicative valve 29", and a second heat exchanging port 452" connected to the thirteenth communicative port 213" and the ninth communicative port 209".

The central fluid inlet 53" of the evaporative cooling unit 5" is connected to the fifth connecting port 405" of the second connecting valve 42". The central fluid outlet 54" is connected to the eighth communicative port 208" of the multi-communicative valve 29".

The evaporator unit 2" has a first evaporator inlet 21" and a second evaporator unit 22". The first evaporator port 21" is connected to the auxiliary frost removal arrangement 28" and the seventh connecting port 207" of the second connecting valve 22". The second evaporator port 22" is connected to the auxiliary frost removal arrangement 28" and the tenth communicative port 210" of the multi-communicative valve 29".

As shown in FIG. 28 of the drawings, the first connecting port 401" of the first connecting valve 41" is connected to the compressor inlet 11" of the compressor unit 1", the fifth communicative port 205" of the multi-communicative valve 29" and the fourth communicative port 204" of the multi-communicative valve 29". The fourth connecting valve 404" of the first connecting valve 41" is connected to the first communicative port 201" of the multi-communicative valve 29". On the other hand, the fifth connecting port 405" is connected to the central fluid inlet 53" of the evaporative cooling system 200". The sixth connecting port 406" is connected to the sixth communicative port 206" of the multi-communicative valve 29" and the thirteenth communicative port 213" thereof. The seventh connecting port 207" is connected to the first evaporator port 21" of the evaporator unit 2" and the auxiliary frost removal arrangement 28". The eighth connecting port 208" is connected to the twelfth communicative port 212" of the multi-communicative valve 29".

For the multi-communicative valve 29", the first communicative port 201" is connected to the fourth connecting port 401" of the first connecting valve 41". The second communicative port 202" is connected to the second water heating unit 463" of the water heater 46", the third communicative port 203", the evaporator unit 2", and the eleventh communicative port 211". The third communicative port 203" is connected to the second communicative port 202" (mentioned above), the evaporator unit 2", and the eleventh communicative port 211". The fourth communicative port 204" is connected to the fifth communicative port 205" in parallel. The fifth communicative port 205" is also connected to the compressor inlet 11" of the compressor unit 1".

Moreover, the sixth communicative port 206" is connected to the sixth connecting port 406" of the second connecting valve 42", and the thirteenth communicative port 413" of the multi-communicative valve 29". The seventh communicative port 207" is connected to the first heat exchanging port 451" of the heat exchanger 45". The eighth communicative port 208" is connected to the central fluid outlet 54" of the evaporative cooling system 200" (i.e. the corresponding multiple-effect evaporative condenser 5"). The ninth communicative port 209" is connected to the second heat exchanging port 452" and the fourteenth communicative port 214". The tenth communicative port 210" is connected to the seventh communicative port 207" and the first heat exchanging port 451" of the water heater 45". The eleventh communicative port 411" is connected to the second evaporator port 22" of the evaporator 2", the auxiliary frost removal arrangement 28", the second communicative port 202", and the second water heating unit 463" of the water heater 46". The twelfth communicative port 212" is connected to the eighth connecting port 408" of the second connecting valve 42". The thirteenth communicative port 213" is connected to the sixth communicative port 206" and the sixth connecting port 406" of the second connecting valve 42". The fourteenth communicative port 214" is connected to the second heat exchanging port 452" of the heat exchanger 45" and the ninth communicative port 209". Finally, the fifteenth communicative port 215" is connected to the twelfth communicative port 212" and the eighth connecting port 408" of the second connecting valve 42". The above described connections are illustrated in FIG. 28 of the drawings.

In the second alternative mode of the present invention, the air conditioning and heat pump system can be selectively operated in an air conditioning mode, a heat pump mode, a water heater mode, and a defrosting mode depending on the flowing route of the refrigerant.

In the air conditioning mode, the first connecting valve 41", the second connecting valve 42", and the multi-communicative valve 29" are all in the normal mode. Superheated or vaporous refrigerant comes out of the compressor unit 1" through the compressor outlet 12". The refrigerant is guided to enter the first water heating unit 462" of the water heater 46" for extracting a predetermined amount of heat to the water contained in the water heater 46".

The refrigerant then leaves the water heater 45" and is guided to pass through the third connecting port 403" and the fourth connecting port 404" of the first connecting valve 41" (because the first connecting valve 41" is in the normal mode). The refrigerant is then guided to flow through the first communicative port 201" of the multi-communicative valve 29". Since it is configured in the normal mode, the refrigerant will pass through the sixth communicative port 206" and flow to the sixth connecting port 406" of the second connecting valve 42". The refrigerant then passes through fifth connecting port 405" and flow into the evaporative cooling system 200" through the central fluid inlet 53". The refrigerant is cooled down by the cooling water in the manner as described above and exits the evaporative cooling system 200" through the central fluid outlet 54". The refrigerant is then guided to pass through the eighth communicative port 208" and the second communicative port 202" of the multi-communicative valve 29". The refrigerant then passes through a unidirectional valve 49", a manual valve 491", a drying filter 47", another manual valve 491", an expansion valve 48", and then the third communicative port 203" of the multi-communicative valve 29". The refrigerant then passes through the tenth communicative port 210" and enters the heat exchanger 45" through the first heat exchanging port 451". The refrigerant is arranged to perform heat exchange in the heat exchanger 45" for absorbing heat from the indoor space. After that, the refrigerant exits the heat exchanger 45" through the second heat exchanging port 452" and passes through the fourteenth communicative port 214". The refrigerant is guided to pass through the fifth communicative port 205" and goes back to the compressor unit 1" via the compressor inlet 11". This completes one refrigerant cycle for air conditioning mode.

When the air conditioning and heat pump system is in the air conditioning mode, the evaporator unit 2" and the second water heating unit 463" are idle. Residual refrigerant trapped in the evaporator unit 2" is guided to leave the evaporator unit 2" through the first evaporator port 21" and pass through the seventh connecting port 407" and the eighth connecting port 408" of the second connecting valve 42", the twelfth communicative port 212" and the fourth communicative port 204" of the multi-communicative valve 29" and merge with the refrigerant coming from the fifth communicative port 205", and eventually go back the compressor unit 1" through the compressor inlet 11".

Residual refrigerant trapped in the second water heating unit 463" is guided to leave the water heater 46" and pass through the second connecting port 402" and the first connecting port 401" of the first connecting valve 41", and merge with the refrigerant coming from the multi-communicative valve 29" and go back to the compressor unit 1" through the compressor inlet 11".

In the heat pump mode, the first connecting valve 41" is configured in the normal mode. The second connecting valve 42" and the multi-communicative valve 29" are configured in the switched mode. Superheated or vaporous refrigerant comes out of the compressor unit 1" through the compressor outlet 12". The refrigerant is guided to enter the first water heating unit 462" of the water heater 46" for extracting a predetermined amount of heat to the water contained in the water heater 46".

The refrigerant then leaves the water heater 45" and is guided to pass through the third connecting port 403" and the fourth connecting port 404" of the first connecting valve 41" (because the first connecting valve 41" is in the normal mode). The refrigerant is then guided to flow through the first communicative port 201" of the multi-communicative valve 29". Since it is configured in the switched mode, the refrigerant will pass through the seventh communicative port 207" and flow to enter the heat exchanger 45" through the first heat exchanging port 451". The refrigerant then perform heat exchange in the heat exchanger 45" and release heat to the indoor space. The refrigerant leaves the heat exchanger 45" through the second heat exchanging port 452". The refrigerant is then guided to pass through the ninth communicative port 209" and the second communicative port 202". The refrigerant goes on to pass through a unidirectional valve 49", a manual valve 491", a drying filter 47", another manual valve 491", an expansion valve 48" and the third communicative port 203" of the multi-communicative valve 29". The refrigerant then pass through the eleventh communicative port 211" and enters the evaporator unit 2" through the second evaporator port 22". The refrigerant performs heat exchange in the evaporator unit 2" and absorb heat from the ambient air. The refrigerant then exits the evaporative unit 2" through the first evaporator port 21" and pass through the seventh connecting port 407" and the sixth connecting port 406" of the second connecting valve 42". The refrigerant is the guided to pass through the thirteenth communicative port 213" and the fourth communicative port 204" of the multi-communicative valve 29". Finally, the refrigerant goes back to the compressor unit 1" through the compressor inlet 11".

When the air conditioning and heat pump system is in the heat pump mode, the evaporative cooling system 200" and the second water heating unit 463" of the water heater 46" are idle. Residual refrigerant trapped in the evaporative cooling system 200" is guided to leave it through the central fluid inlet 53" and pass through the fifth connecting port 405", the eighth connecting port 408" of the second connecting valve 42". The refrigerant is then guided to pass through the fifteenth communicative port 215" and the fifth communicative port 205" of the multi-communicative valve 29" and merge with the refrigerant coming from the fourth communicative valve 204", and eventually go back to the compressor unit 1" through the compressor inlet 11".

On the other hand, the residual refrigerant trapped in the second water heating unit 463" is guided to leave the water heater 46" and pass through the second connecting port 402" and the first connecting port 401" of the first connecting valve 41", and merge with the refrigerant coming from the multi-communicative valve 29" and go back to the compressor unit 1" through the compressor inlet 11".

In the water heater mode, the first connecting valve 41" and the multi-communicative valve 29" are configured in the switched mode. The second connecting valve 42" is configured in the normal mode. Superheated or vaporous refrigerant comes out of the compressor unit 1" through the compressor outlet 12". The refrigerant is guided to enter the first water heating unit 462" of the water heater 46" for extracting a predetermined amount of heat to the water contained in the water heater 46".

The refrigerant then leaves the water heater 46" and is guided to pass through the third connecting port 403" and the second connecting port 402" of the first connecting valve 41" (because the first connecting valve 41" is in the switched mode). The refrigerant is then guided to flow into the second water heating unit 463" of the water heater 46" for extracting additional heat to the water in the water heater 46". The refrigerant leaving the water heater 46" is arranged to flow through a two-way valve 490", a manual valve 491", a drying filter 47", another manual valve 491, an expansion valve 48", and the third communicative port 203" of the multi-communicative valve 29". The refrigerant then passes through the eleventh communicative port 211" and enter the evaporator unit 2" through the second evaporator port 22". The refrigerant then performs heat exchange with the ambient air for absorbing heat and exits the evaporator unit 2" through the first evaporator port 21". The refrigerant is then guided to pass through the seventh connecting port 407" and the eighth connecting port 408" of the second connecting valve 42" (because the second connecting valve 42" is configured in the normal mode). The refrigerant is then guided to flow through the fifteenth communicative port 215" and the fifth communicative port 205" of the multi-communicative valve 29". Finally, the refrigerant goes back to the compressor unit 1" through the compressor inlet 11".

When the air conditioning and heat pump system is in the water heater mode, the evaporative cooling system 200" and the heat exchanger 45" are idle. Residual refrigerant trapped in the evaporative cooling system 200" is guided to leave it through the central fluid inlet 53" and pass through the fifth connecting port 405", the sixth connecting port 406" of the second connecting valve 42". The refrigerant is then guided to pass through the thirteenth communicative port 213" and the fourth communicative port 204" of the multi-communicative valve 29" and merge with the refrigerant coming from the fifth communicative valve 205", and eventually go back to the compressor unit 1" through the compressor inlet 11".

On the other hand, the residual refrigerant trapped in the heat exchanger 45" is guided to leave the heat exchanger 45" through the first heat exchanging port 451" and pass through the seventh communicative port 207" and the first communicative port 201" of the multi-communicative valve 29". The refrigerant is then guided to flow through the fourth connecting port 404" and the first connecting port 401" of the first connecting valve 41", and merge with the refrigerant coming from the multi-communicative valve 29" and go back to the compressor unit 1" through the compressor inlet 11".

In the defrosting mode, the first connecting valve 41" and the multi-communicative valve 29" are configured in the normal mode. The second connecting valve 42" is configured in the switched mode. Superheated or vaporous refrigerant comes out of the compressor unit 1" through the compressor outlet 12". The refrigerant is guided to enter the first water heating unit 462" of the water heater 46" for extracting a predetermined amount of heat to the water contained in the water heater 46".

The refrigerant then leaves the water heater 46" and is guided to pass through the third connecting port 403" and the fourth connecting port 404" of the first connecting valve 41" (because the first connecting valve 41" is in the normal mode). The refrigerant is then guided to pass through the first communicative port 201" and the sixth communicative port 206" of the multi-communicative valve 29". The refrigerant is then guided to flow through the sixth connecting port 406" and the seventh connecting port 407" of the second connecting valve 42". The refrigerant is then guided to flow into the evaporator unit 2" through the first evaporator port 21" and the auxiliary frost removal arrangement 28" for removing frost from the evaporator unit 2". The refrigerant from the evaporator unit 2" and the auxiliary frost removal arrangement 28" then merge again and is guided to flow through a unidirectional valve 49", a manual valve 491", a drying filter 47", another manual valve 491, an expansion valve 48", and the third communicative port 203" of the multi-communicative valve 29". The refrigerant then passes through the tenth communicative port 210" and enters the heat exchanger 45" through the first heat exchanger port 451" for absorbing heat. The refrigerant then exits the heat exchanger 45" through the second heat exchanging port 452" and is guided to pass through the fourteenth communicative port 214", and the fifth communicative port 205" of the multi-communicative valve 29". The refrigerant then goes back to the compressor unit 1" through the compressor inlet 11".

When the air conditioning and heat pump system is in the defrosting mode, the evaporative cooling system 200" and the second water heating unit 463" are idle. Residual refrigerant trapped in the evaporative cooling system 200" is guided to leave it through the central fluid inlet 53" and pass through the fifth connecting port 405", the eighth connecting port 408" of the second connecting valve 42". The refrigerant is then guided to pass through the twelfth communicative port 212" and the fourth communicative port 204" of the multi-communicative valve 29" and merge with the refrigerant coming from the fifth communicative valve 205", and eventually go back to the compressor unit 1" through the compressor inlet 11".

On the other hand, the residual refrigerant trapped in the second water heating unit 463" is guided to leave the water heater 46" and pass through the second connecting port 402" and the first connecting port 401" of the first connecting valve 41", and merge with the refrigerant coming from the multi-communicative valve 29" and go back to the compressor unit 1" through the compressor inlet 11".

The present invention, while illustrated and described in terms of a preferred embodiment and several alternatives, is not limited to the particular description contained in this specification. Additional alternative or equivalent components could also be used to practice the present invention.

What is claimed is:

1. An air conditioning and heat pump system using a predetermined amount of working fluid, comprising:

a multi-communicative valve unit, said multi-communicative valve unit comprising first through fourth connecting valve, said first connecting valve having first through fourth connecting ports, said second connecting valve having fifth through eighth connecting ports, said third connecting valve having ninth through twelfth connecting ports, said fourth connecting valve having thirteenth through sixteenth connecting ports;

a compressor unit connected to said multi-communicative valve unit, said compressor unit having a compressor outlet and a compressor inlet connected to said first connecting port of said first connecting valve;

an evaporator unit connected to said multi-communicative valve unit;

a heat exchanger having a first exchanging port connected to said sixth connecting port of said second connecting valve of said multi-communicative valve unit, and a second exchanging port connected to said fourteenth connecting port of said fourth connecting valve of said multi-communicative valve unit;

a water heater connected to said compressor outlet of said compressor unit and said multi-communicative valve unit;

an evaporative cooling system which comprises at least one multiple-effect evaporative condenser connected to said compressor unit for effectively cooling said working fluid, said multiple-effect evaporative condenser comprising:

an air inlet side and an air outlet side which is opposite to said air inlet side;

a pumping device adapted for pumping a predetermined amount of cooling water at a predetermined flow rate;

a first cooling unit, comprising:

a first water collection basin for collecting said cooling water from said pumping device;

a plurality of first heat exchanging pipes connected to said condenser and immersed in said first water collection basin; and a first fill material unit provided underneath said first heat exchanging pipes, wherein said cooling water collected in said first water collection basin is arranged to sequentially flow through exterior surfaces of said first heat exchanging pipes and said first fill material unit;

a second cooling unit, comprising:

a second water collection basin positioned underneath said first cooling unit for collecting said cooling water flowing from said first cooling unit;

a plurality of second heat exchanging pipes immersed in said second water collection basin; and a second fill material unit provided underneath said second heat exchanging pipes, wherein said cooling water collected in said second water collection basin is arranged to sequentially flow through exterior surfaces of said second heat exchanging pipes and said second fill material unit; and a bottom water collecting basin positioned underneath said second cooling unit for collecting said cooling water flowing from said second cooling unit; and at least one frost removal arrangement which comprises a frost water collection basin provided underneath said evaporator unit, a plurality of heat exchanging pipes provided underneath said frost water collection basin, and a water discharge outlet provided on said frost water collection basin;

said first connecting valve being arranged to be operated between a normal mode and a switched mode, wherein when said first connecting valve is in said normal mode, said first connecting port is connected to said second connecting port while said third connecting port is connected to said fourth connecting port, and when said first connecting valve is in said switched mode, said first connecting port is connected to said fourth connecting port while said second connecting port is connected to said third connecting port;

said second connecting valve being arranged to be operated between a normal mode and a switched mode, wherein when said second connecting valve is in said normal mode, said fifth connecting port is connected to said sixth connecting port while said seventh connecting port is connected to said eighth connecting port, and when said second connecting valve is in said switched mode, said fifth connecting port is connected to said eighth connecting port while said sixth connecting port is connected to said seventh connecting port;

said third connecting valve being arranged to be operated between a normal mode and a switched mode, wherein when said third connecting valve is in said normal mode, said ninth connecting port is connected to said tenth connecting port while said eleventh connecting port is connected to said twelfth connecting port, and when said third connecting valve is in said switched mode, said ninth connecting port is connected to said twelfth connecting port while said tenth connecting port is connected to said eleventh connecting port;

said fourth connecting valve being arranged to be operated between a normal mode and a switched mode, wherein when said fourth connecting valve is in said normal mode, said thirteenth connecting port is connected to said fourteenth connecting port while said fifteenth connecting port is connected to said sixteenth connecting port, and when said fourth connecting valve is in said switched mode, said thirteenth connecting port is connected to said sixteenth connecting port while said fourteenth connecting port is connected to said fifteenth connecting port;

said air conditioning and heat pump system being selectively operated in one of an air conditioning mode, a heat pump mode, and a water heater mode, wherein in said air conditioning mode, said working fluid is guided by said multi-communicative valve to sequentially circulate through said compressor unit, said water heater for releasing heat to a predetermined amount of water, said multiple-effect evaporative condenser for being cooled down by a predetermined amount of cooling water, said heat exchanger for absorbing heat from an indoor space, and back to said compressor unit;

wherein in said heat pump mode, said working fluid is guided by said multi-communicative valve to sequentially circulate through said compressor unit, said water heater for releasing heat to a predetermined amount of water, said heat exchanger for releasing heat to said indoor space, said evaporator unit for absorbing heat from ambient air, and back to said compressor unit; and wherein in said water heater mode, said working fluid is guided by said multi-communicative valve to sequentially circulate through said compressor unit, said water heater for releasing heat to a predetermined of water, said evaporator unit for absorbing heat from ambient air, and back to the compressor unit.

2. The air conditioning and heat pump system, as recited in claim 1, wherein said frost removal arrangement further comprises a plurality of refrigerant guider pipes connected to said heat exchanging pipes respectively for guiding refrigerant to flow in said heat exchanging pipes in a predetermined manner.

3. The air conditioning and heat pump system, as recited in claim 2, wherein said evaporator unit has a first evaporator port connected to said tenth connecting port of said third connecting valve and said auxiliary frost removal arrangement, and a second evaporator port connected to said auxiliary frost removal arrangement and said sixteenth connecting port of said fourth connecting valve.

4. The air conditioning and heat pump system, as recited in claim 3, wherein said evaporative cooling system has a central fluid inlet connected to said cooling units, and a central fluid outlet connected to said cooling units, said central fluid inlet being connected to said twelfth connecting port of said third connecting valve, said central fluid outlet being connected to said thirteenth connecting port of said fourth connecting valve, and said fifteenth connecting port of said fourth connecting valve.

5. The air conditioning and heat pump system, as recited in claim 4, wherein said water heater comprises a heater housing having a water inlet provided at a lower portion thereof, and a water outlet provided at an upper portion of said heater housing, a first water heating unit connecting between said compressor unit and said third connecting port of said first connecting valve, and a second water heating unit connecting to said second connecting port of said second connecting valve, said thirteenth connecting port of said fourth connecting valve, and said fifteenth connecting port of said fourth connecting valve.

6. The air conditioning and heat pump system, as recited in claim 5, wherein said fourth connecting port of said first connecting valve is connected to said seventh connecting port of said second connecting valve.

7. The air conditioning and heat pump system, as recited in claim 6, wherein said eighth connecting port of said second connecting valve is connected to said eleventh connecting port of said third connecting valve.

8. The air conditioning and heat pump system, as recited in claim 7, wherein said thirteenth connecting port of said fourth connecting valve is externally connected to said fifteenth connecting port of said fourth connecting valve.

9. The air conditioning and heat pump system, as recited in claim 8, wherein when said air conditioning and heat pump system is operated in said air conditioning mode, said first connecting valve, said second connecting valve, said third connecting valve and said fourth connecting valve are configured in said normal mode.

10. The air conditioning and heat pump system, as recited in claim 9, wherein when said air conditioning and heat pump system is operated in said heat pump mode, said first connecting valve is configured in said normal mode, and said second connecting valve, said third connecting valve and said fourth connecting valve are configured in said switched mode.

11. The air conditioning and heat pump system, as recited in claim 10, wherein when said air conditioning and heat pump system is operated in said water heater mode, said first connecting valve and said fourth connecting valve are configured in said switched mode, and said second connecting valve and said third connecting valve are configured in said normal mode.

12. The air conditioning and heat pump system, as recited in claim 1, being selectively operated in said air conditioning mode, said heat pump mode, said water heater mode, and a defrosting mode, wherein in said defrosting mode, said refrigerant is guided to sequentially circulate through said compressor unit, said water heater for releasing heat to said water in said water heater, said evaporator unit and said auxiliary frost removal arrangement for releasing heat to remove frost from said evaporator unit, said heat exchanger for absorbing heat from said indoor space, and back to said compressor unit for completing one defrosting cycle.

13. The air conditioning and heat pump system, as recited in claim 11, being selectively operated in said air conditioning mode, said heat pump mode, said water heater mode, and a defrosting mode, wherein in said defrosting mode, said refrigerant is guided to sequentially circulate through said compressor unit, said water heater for releasing heat to said water in said water heater, said evaporator unit and said auxiliary frost removal arrangement for releasing heat to remove frost from said evaporator unit, said heat exchanger for absorbing heat from said indoor space, and back to said compressor unit for completing one defrosting cycle.

14. The air conditioning and heat pump system, as recited in claim 13, wherein when said air conditioning and heat pump system is operated in said defrosting mode, said first connecting valve, said second connecting valve and said fourth connecting valve are configured in said normal mode, and said third connecting valve is configured in said switched mode.

15. The air conditioning and heat pump system, as recited in claim 12, further comprising a cooler switching circuitry for selectively switching said air conditioning and heat pump system from operating in a water-cooled mode in which said refrigerant is cooled by said evaporative cooling system, and an air-cooled mode in which said refrigerant is cooled by said evaporator unit when said air conditioning and heat pump system is operated in said air conditioning mode.

16. The air conditioning and heat pump system, as recited in claim 14, wherein said cooler switching arrangement comprises a selection switch, a temperature switch, and a water level switch, each of said selection switch, said temperature switch, and said water level switch being arranged to be switched between two positions so as to selectively conduct electricity between a main power source and said corresponding selection switch, temperature switch, and water level switch.

* * * * *